US010909859B1

(12) United States Patent
Dodd

(10) Patent No.: US 10,909,859 B1
(45) Date of Patent: Feb. 2, 2021

(54) OPTIMIZED DEPLOYMENT OF REMOTELY OPERATED AERIAL VEHICLE RESOURCES FROM A FLEET TO SATISFY REQUESTS FOR REMOTELY OPERATED AERIAL VEHICLE RESOURCES

(71) Applicant: Michael B. Dodd, Salt Lake City, UT (US)

(72) Inventor: Michael B. Dodd, Salt Lake City, UT (US)

( * ) Notice: Subject to any disclaimer, the term of this patent is extended or adjusted under 35 U.S.C. 154(b) by 249 days.

(21) Appl. No.: 16/029,654

(22) Filed: Jul. 9, 2018

Related U.S. Application Data

(60) Provisional application No. 62/531,354, filed on Jul. 12, 2017.

(51) Int. Cl.
*G08G 5/00* (2006.01)
*G07C 5/08* (2006.01)

(52) U.S. Cl.
CPC ..... *G08G 5/0043* (2013.01); *G07C 5/085* (2013.01); *G07C 5/0808* (2013.01); *G07C 5/0816* (2013.01); *G08G 5/0034* (2013.01); *G08G 5/0095* (2013.01)

(58) Field of Classification Search
CPC ... G08G 5/0034; G08G 5/0043; G08G 5/0095
See application file for complete search history.

(56) References Cited

U.S. PATENT DOCUMENTS

2016/0155339 A1* 6/2016 Saad ..... H04L 69/18 701/25
2016/0364989 A1* 12/2016 Speasl ..... G06Q 10/08
2020/0105149 A1* 4/2020 Mahkonen ..... B64C 39/024

* cited by examiner

*Primary Examiner* — Imran K Mustafa
(74) *Attorney, Agent, or Firm* — Dodd Law Group, LLC; Michael B. Dodd

(57) ABSTRACT

The present invention extends to methods, systems, devices, and apparatus for optimized deployment of remotely operated aerial vehicle resources from a fleet to satisfy requests for remotely operated aerial vehicle resources. In some aspects, requests for remotely operated aerial vehicle resources have constraints specifying particular resources and/or specifying particular types of resources.

13 Claims, 8 Drawing Sheets

OPTIMIZED DEPLOYMENT OF REMOTELY OPERATED AERIAL VEHICLE RESOURCES FROM A FLEET TO SATISFY REQUESTS FOR REMOTELY OPERATED AERIAL VEHICLE RESOURCES

CROSS-REFERENCE TO RELATED APPLICATIONS

This application claims the benefit of and priority to U.S. Provisional Patent Application Ser. No. 62/531,354 entitled "OPTIMIZED DEPLOYMENT OF REMOTELY OPERATED AERIAL VEHICLE RESOURCES FROM A FLEET TO SATISFY REQUESTS FOR REMOTELY OPERATED AERIAL VEHICLE RESOURCES", filed Jul. 12, 2017 by Michael B. Dodd, the entire contents of which are expressly incorporated by reference.

BACKGROUND

1. Background and Relevant Art

The number of remotely operated (e.g., piloted) aerial vehicles, including unmanned aerial vehicles (UAVs), being flown continues to increase. A variety of different entities including hobbyists, delivery companies, intelligence agencies, surveyors, power companies, etc. use Remotely Operated Aerial Vehicles. Some Remotely Operated Aerial Vehicles operate past line of sight. On an ongoing basis and/or at a destination, the Remotely Operated Aerial Vehicle provides images and/or video of its surroundings back to a monitoring system (which may or may not be the location of the operator). The Remotely Operated Aerial Vehicle can also perform other activities, such as, delivering a package. Hobbyists typically use UAVs within line of sight as a recreational activity. These UAVs may or may not provide images and/or video back to the operator.

In many operating environments, a Remotely Operated Aerial Vehicle can be launched from a launch location accessible to the operator (e.g., hobbyist or pilot) and/or maintenance personnel. The Remotely Operated Aerial Vehicle is flown for some amount of time or to complete a specified mission. The Remotely Operated Aerial Vehicle is then flown to a landing location (which may or may not be the same as the launch location) and lands.

Some Remotely Operated Aerial Vehicles may also operate autonomously and/or in communication with a computer system. For example, a Remotely Operated Aerial Vehicle can be programmed to follow a designated path between different sets of coordinates. In some environments, a standby pilot can monitor a Remotely Operated Aerial Vehicle during autonomous or computer controlled flight. When appropriate (e.g., due to component failures, weather conditions, etc.), the pilot can disrupt autonomous flight and assume control of the Remotely Operated Aerial Vehicle. As such, the pilot may be able to safely land a Remotely Operated Aerial Vehicle when autonomous or computer controlled flight becomes unsafe.

BRIEF SUMMARY

The present invention extends to methods, systems, devices, apparatus, and computer program products for optimized deployment of remotely operated aerial vehicle resources from a fleet to satisfy requests for remotely operated aerial vehicle resources. In some aspects, requests for remotely operated aerial vehicle resources have constraints specifying particular resources and/or specifying particular types of resources.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific implementations thereof which are illustrated in the appended drawings. Understanding that these drawings depict only some implementations of the invention and are not therefore to be considered to be limiting of its scope, the invention will be described and explained with additional specificity and detail through the use of the accompanying drawings in which.

DETAILED DESCRIPTION

Figure 1:
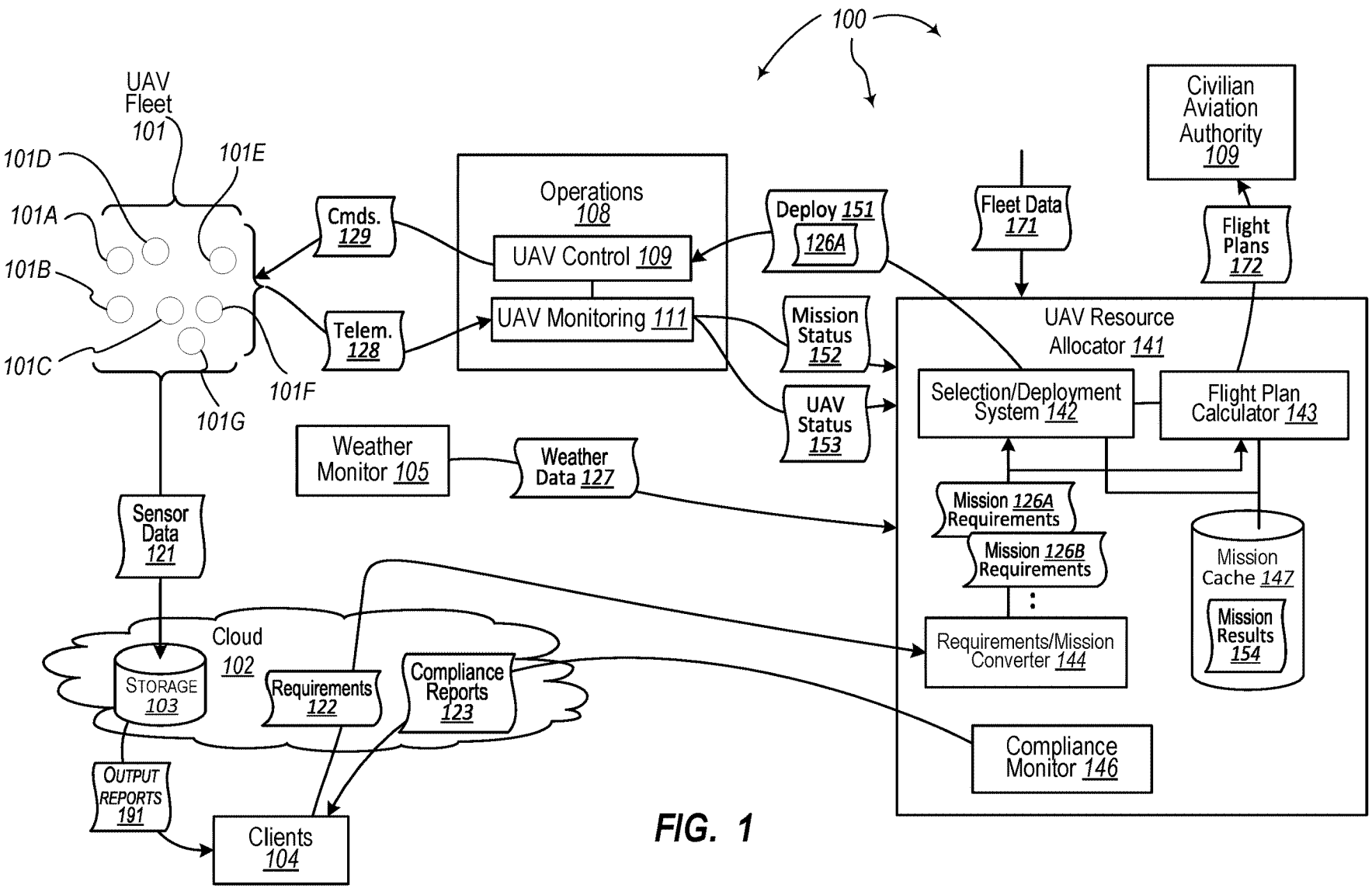
FIG. 1 illustrates an example computer architecture for optimizing deployment of UAV resources from a fleet to satisfy requests for UAV resources.

The present invention extends to methods, systems, devices, apparatus, and computer program products for optimized deployment of remotely operated aerial vehicle resources from a fleet to satisfy requests for remotely operated aerial vehicle resources. In some aspects, requests for remotely operated aerial vehicle resources have constraints specifying particular resources and/or specifying particular types of resources.

In some aspects, a vehicle is a Remotely Operated Aerial Vehicle, such as, a Remotely Piloted Aircraft (RPA) (and is potentially unnamed, for example, an Unmanned Aerial Vehicle (UAV)). In some aspects, a remotely operated aerial vehicle is a rotor-based UAV that includes a plurality of rotors. In some aspects, a rotor-based UAV is a quad-rotor UAV. In other aspects, a rotor-based UAV includes five or more rotors. A rotor based UAV can use rotors for one or more of: lift, maneuvering, and to change orientation. A UAV may be capable of vertical takeoff and landing ("VTOL")

In this description and the following claims, a "flight plan" is defined as documentation filed with a Civil Aviation Authority (e.g., the Federal Aviation Administration (FAA)) in the United States) indicating an aircraft's planed route or flight path. A flight plan can include basic information, such as, departure and arrival points, estimated time en route, alternate airports in case of bad weather, type of flight (whether instrument flight rules (IFR) or visual flight rules (VFR)), a pilot's information, and information about the aircraft itself.

In many countries, flight plans are required for flights under IFR, but may be optional for flying VFR unless crossing international borders. For IFR flights, flight plans are used by air traffic control to initiate tracking and routing services. For VFR flights, flight plans provide needed information should search and rescue operations be required, or for use by air traffic control when flying in a "Special Flight Rules Area".

In some aspects, a Remotely Operated Aerial Vehicle is approved for past line of sight flight based on certification, exception, exemption, etc. and may fly with IFR. As such, a flight plan can be submitted to an appropriate governmental agency (e.g., the Federal Aviation Administration (FAA)) for a Remotely Operated Aerial Vehicle that is to fly IFR. A flight plan can be generated by an operator or pilot, or generated automatically by a computer system based on received mission parameters. A flight plan can be submitted manually, via telephone, or digitally (e.g., using DUATs or other electronic systems) to a Civil Aviation Authority. Digital submission can be automated using computer systems.

In some aspects, client requirements are defined in a Service Level Agreement (SLA). In this description and the following claims, a Service Level Agreement (SLA) is defined as an agreement between a service provider and a client. The SLA defines particular aspects of a service, for example, quality, availability, responsibilities, etc., to be provided by the service provider to the client. An SLA can be between two or more parties. An SLA can be a legally binding formal or an informal "contract" (for example, internal department relationships). An SLA can involve separate organizations, or different teams within one organization.

A service provider can have Operating Level Agreements (OLAs) with third parties in support of an SLA.

SLAs may include many components, including but not limited to:

(a) Specifying the type of service and any additional details of type of service to be provided. In case of Remotely Operated Aerial Vehicle Resources, type of service can include both operational and maintenance functions. Operational functions can include providing a pilot with requisite qualifications/certifications (e.g., IFR certified, equipment type certified, etc.), flying a specified mission, flying for a specified duration, flying between specified locations, flying a specified route (flight plan), hovering in a specified location for a specified amount of time, reliable air band communication (e.g., to Air Traffic Control), taking images and/or video or capturing data with other types of sensors (Lidar, Radar, etc.). Maintenance functions can include replenishing fuel (e.g., battery, liquid, etc.) resources, inspecting Remotely Operated Aerial Vehicles and components for airworthiness, replacing failed and/or aged components on a Remotely Operated Aerial Vehicle, changing sensors, etc.

(b) The service's desired performance level, for example, reliability and responsiveness. Specified minimum acceptable disruption over time and availability over time. In case of Remotely Operated Aerial Vehicle resources, a performance level can indicate a minimum elapsed time from a mission request to mission completion.

(c) How performance levels are supervised and monitored. Supervision and monitoring performance levels can include gathering of different type of statistics. Frequency of collection and customer access to statistics can be agreed to between the service provider and client. For example, how often are high resolution images of a pipeline provided to a client within one hour of a request for images.

(d) How performance problems are reported. Reporting performance problems can include contact details to report a problem and an order in which details about the issue have to be reported.

(e) Response time-frame is the time period by which the service provider will start the investigation of the issue. Issue resolution time-frame is the time period by which the current service issue is resolved and fixed (f) Repercussions for failure to meet commitment. If the service provider is not able to meet the requirements as stated in SLA then service provider is subject to consequences for the same. These consequences may include customer's right to terminate the contract or ask for a refund for losses incurred by the customer due to failure of service.

Aspects of the invention can be used to provide remotely operated aerial vehicle resources as a service. For example, deployment of remotely operated aerial vehicle resources from a fleet of remotely operated aerial vehicles can be optimized to more efficiently perform missions in compliance with a plurality of SLAs.

In general, resources of an appropriate Remotely Operated Aerial Vehicle can be deployed to provide service for one or more missions in accordance with one or more SLAs. Selection and deployment of Remotely Operated Aerial Vehicle resources can be facilitated by comparing locations and resources (capabilities) of available Remotely Operated Aerial Vehicles within a fleet of Remotely Operated Aerial Vehicle to receive requests, including any indicated resource constraints (e.g., images above a specified resolution, etc.).

In one aspect, a resource request can be broken down into one or more discrete missions. Selection and deployment of Remotely Operated Aerial Vehicle resources can be facilitated by comparing locations and resources (capabilities) of available Remotely Operated Aerial Vehicles within a fleet to mission constraints. Mission constraints can include mission type, mission duration, mission start location, mission path, mission end location, mission sensor requirements, mission time constraints (start by, finish by, etc.), current weather conditions, etc. Based on the comparisons, resources of an appropriate Remotely Operated Aerial Vehicle can be selected and deployed from the fleet to complete the mission (and satisfy a resource request). Various different characteristics of available Remotely Operated Aerial Vehicles and of the mission can be considered when selecting and deploying resources of an appropriate Remotely Operated Aerial Vehicle to complete a mission.

In one aspect, a total cost of mission is determined per Remotely Operated Aerial Vehicle for any available Remotely Operated Aerial Vehicles with sensors satisfying minimum mission sensor requirements, that can meet time constraints for the mission, that can operate in the current weather conditions, and for which there is an available operator/pilot. For each Remotely Operated Aerial Vehicle, total cost of mission can be based on cost per hour of flight time (derived from refueling/recharging cost, maintenance cost, operator/pilot cost, sensor operation cost, etc.) for the Remotely Operated Aerial Vehicle, distance from Remotely Operated Aerial Vehicle location to mission start location, mission path, and distance from mission end location to selected docking station.

Remotely Operated Aerial Vehicles with lower cost of mission can be viewed as better selections to complete a mission relative to Remotely Operated Aerial Vehicles with higher cost of mission. It may be cost effective to fly a Remotely Operated Aerial Vehicle from further away if cost per hour of flight for the Remotely Operated Aerial Vehicle is significantly lower. In one aspect, a Remotely Operated Aerial Vehicle having resources exceeding minimum mission requirements (flight time, sensor capabilities, etc.) by the smallest amount in the fleet is selected and deployed. Using minimum resources to satisfy mission requirements saves money and also permits Remotely Operated Aerial Vehicle with more powerful capabilities to remain available for other missions.

When appropriate, a flight plan for a selected Remotely Operated Aerial Vehicle can be (e.g., automatically) generated and (e.g., automatically) submitted to a Civilian Aviation Authority prior to deployment. A flight plan can be tailored to indicate that the path of the Remotely Operated Aerial Vehicle is to include one or more locations (or a continuous path of locations) where resources of the Remotely Operated Aerial Vehicle are provide service to satisfy a request for Remotely Operated Aerial Vehicle resources with and/or to satisfy an SLA (e.g., capturing images or video).

In some aspects, resources of a single Remotely Operated Aerial Vehicle are deployed to satisfy multiple requests for Remotely Operated Aerial Vehicle resources in a single flight. For example, a Remotely Operated Aerial Vehicle can fly to one location and capture images (or drop a package) to satisfy one resource request and then fly to another location and capture images to satisfy another resource request.

In some aspects, the resources of multiple Remotely Operated Aerial Vehicles are to be used to satisfy a request for Remotely Operated Aerial Vehicle sources (e.g., as part of a mission and/or in accordance with an SLA). Resources of multiple Remotely Operated Aerial Vehicles can be used for any number of reasons. In one aspect, different Remotely Operated Aerial Vehicles include different resources (e.g., different cameras or sensors). Each sensor can be used to fulfill part of a resources request (e.g., an agreed to service for a client).

It may also be that mission requirements change. For example, a Remotely Operated Aerial Vehicle with a lower resolution camera may be deployed to monitor a security perimeter. The lower resource camera may detect a moving object within the security perimeter. In response, an additional Remotely Operated Aerial Vehicle with a higher resolution camera can be deployed to take additional images (or live stream video) for use in determining the exact nature of the moving object (e.g., human or other animal).

In another aspect, mission length may exceed the specified flight time for a Remotely Operated Aerial Vehicle, for example, based on available fuel resources (e.g., battery life). For example, it may take 90 minutes of flight time to record video of part of a utility line. However, the maximum flight time (e.g., based on battery life) for Remotely Operated Aerial Vehicles used to monitor the utility line is one hour. Thus, two different Remotely Operated Aerial Vehicles can be deployed and operated, either serially or in parallel. (the amount of time for recharging batteries may exceed the time parameters associated with the mission).

When the resources of multiple Remotely Operated Aerial Vehicles are to be used to satisfy a request for resources (e.g., to provide service for a mission in accordance with and/or to satisfy an SLA), a flight plan can be (e.g., automatically) generated and (e.g., automatically) submitted to a Civilian Aviation Authority for one, some, or all of the multiple Remotely Operated Aerial Vehicles. Each flight plan can be tailored to indicate that the path of a Remotely Operated Aerial Vehicle is to include one or more locations (or a continuous path of locations) where the Remotely Operated Aerial Vehicle is to provide service (or a portion thereof) in accordance with and/or to (at least partially) satisfy an SLA.

In a further aspect, a Remotely Operated Aerial Vehicle may start a mission responsive to a resource request (e.g., to provide service (or portion thereof) in accordance with and/or to (at least partially) satisfy an SLA). However, for one or more reasons the Remotely Operated Aerial Vehicle is unable to complete the mission. In this further aspect, resources of a replacement Remotely Operated Aerial Vehicle can be selected and deployed to replace the resources of Remotely Operated Aerial Vehicle. The replacement Remotely Operated Aerial Vehicle furthers the mission and satisfying resources requirements (e.g., provides service (or a remaining portion thereof) in accordance with and/or to (further) satisfy an SLA).

When appropriate, a replacement flight plan can be (e.g., automatically) generated and (e.g., automatically) submitted to a Civilian Aviation Authority for the replacement Remotely Operated Aerial Vehicle. The replacement flight plan can be tailored to indicate that the path of the replacement Remotely Operated Aerial Vehicle is to include one or more locations (or a continuous path of locations) where the Remotely Operated Aerial Vehicle is to satisfy resource requirements (e.g., to provide service (or a remaining portion thereof) in accordance with and/or to (further) satisfy an SLA).

In one aspect, multiple replacement Remotely Operated Aerial Vehicles are selected and deployed to replace a Remotely Operated Aerial Vehicle. In another aspect, one replacement Remotely Operated Aerial Vehicles is selected and deployed to replace multiple other Remotely Operated Aerial Vehicles. In a further aspect, multiple different Remotely Operated Aerial Vehicles are unable to complete portions of a mission (either serially or in parallel). Replacement Remotely Operated Aerial Vehicles can be selected and deployed for each of the multiple different Remotely Operated Aerial Vehicles.

An inability of a Remotely Operated Aerial Vehicles to complete a mission may be caused by component failure or malfunction. A component failure or malfunction may be related to safety or airworthiness (e.g., a rotor failure, guidance system malfunction, engine failure, Automatic dependent surveillance-broadcast (ADS-B) malfunction, etc.) or not related to safety or airworthiness (e.g., gimbal is frozen, camera won't focus, etc.). When a component failure or malfunction is related to safety or airworthiness, a Remotely Operated Aerial Vehicle can abort a current mission and (essentially immediately) return to a designated location (e.g., a docking station) for maintenance and/or repair. When return for maintenance and/or repair is not possible, the Remotely Operated Aerial Vehicle can land in any other safer location. When a component failure or malfunction is not related to airworthiness, a Remotely Operated Aerial Vehicle may continue to perform other aspects of a mission as appropriate to satisfy resource requests (e.g., provide service (or a portion thereof) in accordance with and/or to (at least partially) satisfy an SLA).

A component failure can be caused due to damage, for example, colliding with a bird, lighting strike, etc. In other cases, the cause of a component failure or malfunction may be unknown.

An inability to complete a mission may be caused by weather, such as, high winds, fog, lighting, etc. If weather conditions in a locality prevent resources of a Remotely Operated Aerial Vehicle from progressing a mission satisfy a resource request (e.g., providing service in accordance with and/or to satisfy the SLA), resoruces of a a replacement Remotely Operated Aerial Vehicle can be deployed from another location. The other Remotely Operated Aerial vehicle can move toward a mission from the location on a different approach to avoid, or at least mitigate the impact of, the weather conditions. In another aspect, a more durable Remotely Operated Aerial vehicle (e.g., with a higher wind rating) can be deployed to progress a mission when a less durable Remotely Operated Aerial vehicle (e.g., with a lower wind rating) is unable to continue due to weather conditions.

When appropriate, an additional flight plan can be (e.g., automatically) generated and (e.g., automatically) submitted to a Civilian Aviation Authority for the replacement Remotely Operated Aerial Vehicle. The additional flight plan can be tailored to indicate the different approach and that the path of the replacement Remotely Operated Aerial Vehicle is to include one or more locations (or a continuous path of locations) where the replacement Remotely Operated Aerial Vehicle is to resume satisfying a request for resources (e.g., providing service in accordance with and/or to satisfy the SLA).

Accordingly, in some aspects, resources of multiple Remotely Operated Aerial Vehicles can interoperate to satisfy a request for Remotely Operated Aerial Vehicles resources (e.g., provide service for a mission in accordance with an SLA).

In general, Remotely Operated Aerial Vehicles can be selected from and/or deployed from a ground based location or from an airborne location. Remotely Operated Aerial Vehicles can operate autonomously and/or can be operated by an operator. The operator may be a certified pilot.

When a Remotely Operated Aerial Vehicle is in flight, analog and/or digital systems can be used to receive data from, monitor, and control the Remotely Operated Aerial Vehicle. Monitoring and control equipment can be co-located with and/or separate one another. Information exchanged between remotely operated aerial vehicles and monitoring and control equipment can be relayed over a wired and/or wireless communication networks (e.g., e.g., from among 3G cellular, 4G cellular, satellite, Wi-Fi, WiMAX, airband, etc).

Exchanged information can include commands and telemetry. Commands can include pilot commands, instructions for autonomous operations, etc. Telemetry can include power data (e.g., battery status), engine data, environmental data (e.g., temperature, altitude, direction, etc.), other flight system data, control/computer system data, etc.

In one aspect, collected sensor data (images, video, etc. sensed at sensors mounted to a Remotely Operated Aerial Vehicle) is stored locally at a Remotely Operated Aerial Vehicle and retrieved from the Remotely Operated Aerial Vehicle upon return to a ground based location. In another aspect, collected sensor data is transmitted from a Remotely Operated Aerial Vehicle during flight (possibly essentially in real time). A data management system can receive and store the collected sensor data. The sensor data can be delivered to a customer/client to comply with a request Remotely Operated Aerial Vehicle resources. In one aspect, collected sensor data is sent for storage in the cloud and/or to a cloud-based appliance.

A Remotely Operated Aerial Vehicle can send telemetry data indicating the status of systems on the Remotely Operated Aerial Vehicle. A monitoring system can receive telemetry for a plurality Remotely Operated Aerial Vehicles and monitor the operational status (and airworthiness) of the plurality of Remotely Operated Aerial vehicles simultaneously based on the telemetry.

In the following Figures reference is made to Unmanned Aerial Vehicles (UAV's). It should be understood that aspects described with respect to UAVs are similarly applicable to other Remotely Operation Aerial Vehicles.

FIG. 1 illustrates an example computer architecture 100 for optimizing deployment of vehicle resources from a fleet to satisfy requests for remotely operated aerial vehicle resources. Referring to FIG. 1, computer architecture 100 includes UAV fleet 101, cloud 102, clients 104, UAV resource allocator 141, civilian flight authority 109, and operations 108. UAV fleet 101, cloud 102, clients 104, UAV resource allocator 141, civilian flight authority 109, and operations 108 can be connected to (or be part of) a network, such as, for example, a system bus, a Local Area Network ("LAN"), a Wide Area Network ("WAN"), and even the Internet. Accordingly, UAV fleet 101, cloud 102, clients 104, UAV resource allocator 141, civilian flight authority 109, and operations 108 as well as any other connected computer systems and their components can create and exchange message related data (e.g., Internet Protocol ("IP") datagrams and other higher layer protocols that utilize IP datagrams, such as, Transmission Control Protocol ("TCP"), Hypertext Transfer Protocol ("HTTP"), Simple Mail Transfer Protocol ("SMTP"), Simple Object Access Protocol (SOAP), etc. or using other non-datagram protocols) over the network.

As depicted, UAV fleet 101 incudes UAVs 101A-101G (additional UAVs may also be included). UAVs in UAV fleet 101 may be owned by a common entity (e.g., service provider). The common entity (e.g., service provider) can enter into requirements 122 with clients 104. UAV fleet 101 can include the same as well as different types of UAVs. Within UAV fleet 101, some UAVs can have the same configuration and/or capabilities as other UAVs. Within UAV fleet 101, some UAVs can have different configuration and/or capabilities as other UAVs. The configurations and capabilities of UAVs in UAV fleet 101 can be indicated in fleet data 171.

UAVs from UAV fleet 101 can be deployed on missions at different times and/or for different durations. UAV missions can include using attached sensors to collect data for a client.

As depicted, cloud 102 includes storage 103. Storage 103 can be used to store sensor data collected by UAVs. The sensor data can be used to generate output reports 191 (e.g., a set of images, a video, etc.) for clients 104. Other data, such as, requirements 122 and compliance reports 123, can also be stored in cloud 103 when be transferred between clients 104 and UAV resource allocator 141 or vice versa.

Weather monitor 105 can monitor weather in locations where any of UAVs 101A-101G are operating, attempting to operate, or desiring to operate (e.g., airborne) and/or are docked (e.g., on the ground). Weather monitor 105 can send weather data 127 to UAV resource allocator 141. Weather data 127 can include relevant weather conditions where any of UAVs 101A-101G are operating, attempting to operate, or desiring to operate (e.g., airborne) and/or are docked (e.g., on the ground). Weather data 127 can include temperature, visibility, barometric pressure, wind direction, sustained wind speed, gust wind speed, dew point, thunder storm activity, precipitation type, relative humidity, hail, fog, snow, etc.

UAV resource allocator 141 includes requirements/mission converter 144, selection/deployment system 142, flight plan calculator 143, and compliance monitor 146. Requirements/mission converter 144 can convert an requirement 122 into one or more UAV missions. Each mission can have mission requirements (e.g., recording images or video, delivering a package etc.), such as, for example, mission requirements 126A, 126B, etc. Requirements/mission converter 144 can send mission requirements to selection/deployment system 142. In one aspect, each mission is viewed as an objective of a resource request. A resource request can include multiple objectives. When a resource request is an SLA, each mission can be viewed as a Service Level Objective (SLO) of the SLA.

Mission cache 147 can include mission results 154 documenting characteristics of previously performed missions. Per mission, mission results 154 can be recorded in mission cache 147. Per mission, mission results 154 can indicate mission requirements, each UAV that at least attempted to perform at least one mission requirement (by UAV type, UAV configuration, attached sensor configuration, other payload, etc.), mission outcome (all mission requirements met, number of mission requirements met, pass, fail, etc.), date/time mission was received, date/time each UAV was deployed, date/time each UAV completed a mission requirement, weather conditions per UAV, inability of any UAV to complete any mission requirement due to weather conditions, technical difficulties of any UAVs, (e.g., component failure or component malfunction), inability of any UAV to complete any mission requirement due to technical difficulties, if any replacement UAVs were deployed and for what reason, a flight plan (if any) corresponding to each UAV, etc.

Per mission, compliance monitor 146 can compare missions results 154 to requirements of a corresponding requirement 122 to determine if the mission was performed in accordance with the requirement 122. Compliance monitor 146 can generate a compliance report 123 indicating any relevant results identified through the comparison. Compliance monitor 146 can store the compliance report 123 in cloud 102 for access by a client 104.

Selection/Deployment system 142 can access mission requirements 126A, 126B, etc. Per mission requirements (e.g., 126A or 126B), selection/deployment system 142 can refer to fleet data 171 to identify a UAV in UAV fleet 101 that is capable of performing the mission requirements (e.g., 126A or 126B) in accordance with a requirement 122. Identification of a UAV can be based on UAV type and configuration and sensor configuration or other payload. Selection/Deployment system 142 can use a selection (matching) algorithm to select one or more available UAVs from UAV fleet 101 to satisfy a resource request. The selection (matching) algorithm can consider any of the described types of data for a mission, for UAVs, etc.

In one aspect, Selection/Deployment system 142 refers to mission cache 147 to determine if a mission has been previously performed and/or if a particular UAV was well suited to a similar mission in the past. Reference to mission cache 147 can minimize computations performed by the selection (matching) algorithm thereby conserving computing and memory resources.

For a selected UAV, selection/deployment system 142 can determine if a flight plan is appropriate (e.g., if the UAV is to be flying past line of sight). If so, selection/deployment system 142 can instruct flight plan calculator 143 to calculate and submit a flight plan 172 for the identified UAV. Flight plan calculator 143 can (e.g., automatically) calculate flight plan 172 for the UAV. Flight plan calculator 143 can tailor flight plan 172 so that the UAV's path of travel puts the UAV in locations that meet mission requirements (e.g., 126A or 126B) in accordance with a requirement 122 and/or puts the UAV in locations where mission requirements (e.g., 126A or 126B) can be met (e.g., sensor data gathered) in accordance with a requirement 122. Thus, at least to some extent, a generated flight plan is based on the use of requested UAV resources.

Flight plan calculator 143 can (e.g., automatically) submit the flight plan 172 to civilian aviation authority 109 in response to commands from selection/deployment system 142.

Selection/Deployment system 142 can send deploy order 151, including mission requirements 126A or 126B (and, when appropriate, flights plans 172) to operations 108. UAV control 109 can receive deploy order 151. UAV control 109 can send commands 129 to the selected one or more available UAVs in UAV fleet 101. Commands 129 instruct each of the one or more UAVs to fly (in an automated manner and/or under the control of an operator) to one or more locations defined in mission requirements (e.g., 126A or 126B) and, when appropriate, in accordance with a flight plan 172. Commands 129 can be automated commands from a computer and/or commands from a human operation, such as, a certified UAV pilot.

As deployed UAVs from UAV fleet 101 attempt to perform mission requirements, the UAVs can send telemetry 128 to operations 108 on an ongoing basis. UAV monitoring 111 can receive telemetry 128 from each UAV. From telemetry 128, UAV monitoring 111 can determine if a UAV is operating in an intended manner, is having technical difficulties (e.g., component failure or malfunction), is airworthy, is experiencing weather exceeding its ratings, etc.

Per UAV, UAV monitoring 111 can formulate a UAV status 153. UAV monitoring 111 can send the UAV status 153 to UAV resource allocator 141. Based on telemetry 128 from one or more UAVs associated with a mission, UAV monitoring 111 can also formulate mission status 152. Mission status 152 can indicate progress of a mission, any mission difficulties, etc. UAV monitoring 111 can send mission status 152 to UAV resource allocator 141.

Any deployed UAVs can send sensor data 121 to storage 103.

Based on mission status 152 and or UAV status 153, selection/deployment system 142 may deploy additional and/or replacement UAVs to satisfy mission requirements (e.g., 126A or 126B) in accordance with a requirement 122. For each deployed UAV, selection/deployment system 142 can determine if a flight plan is appropriate. If so, selection/ deployment system 142 can send relevant instructions to flight plan calculator 143. Flight plan calculator 143 can calculate and submit (possibly automatically) any flight plans to civilian aviation authority 109.

Figure 2A:
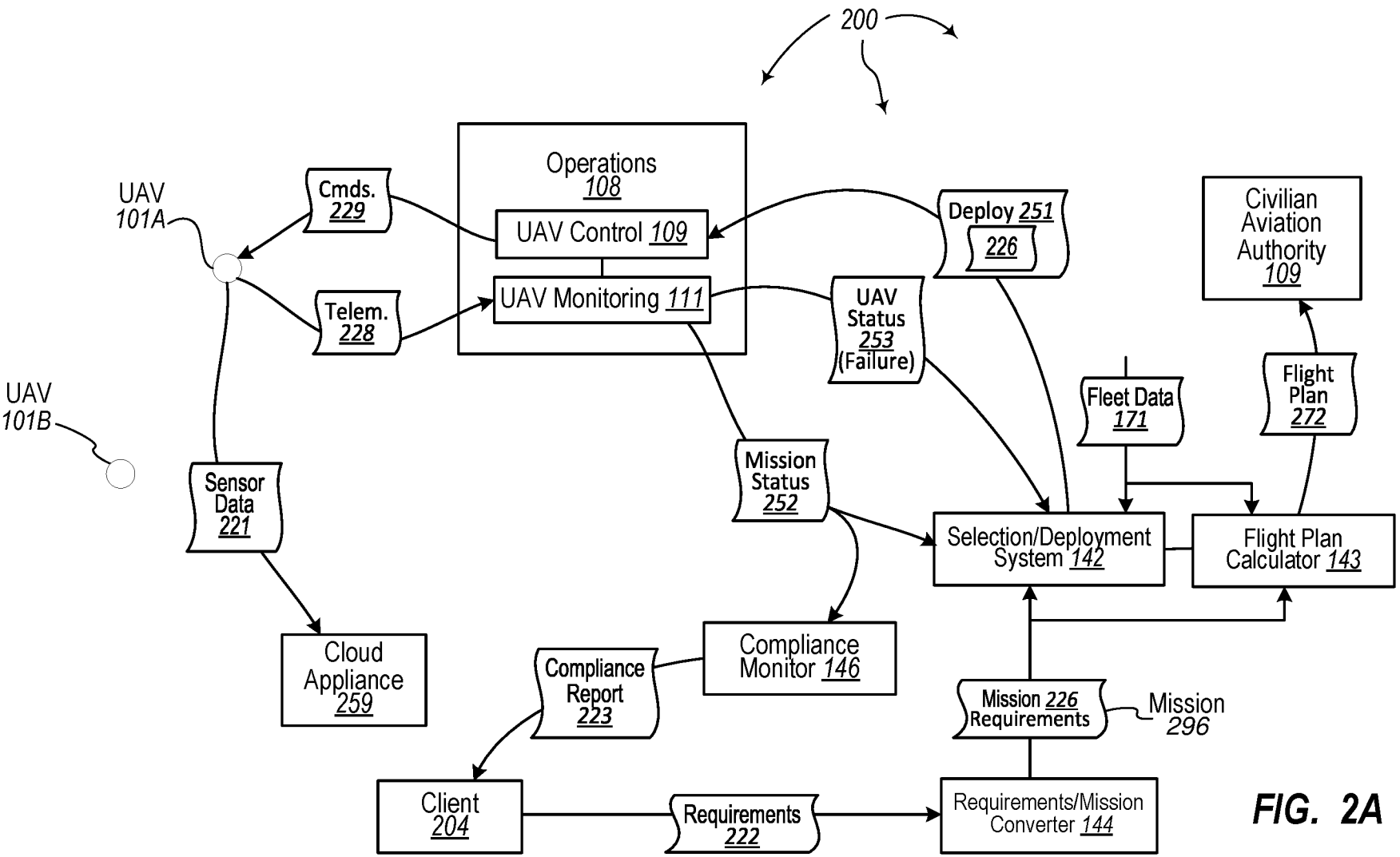
FIGS. 2A and 2B illustrates an example computer architecture for deploying a replacement UAV from a fleet to satisfy the remainder of a request for UAV resources.
Figure 2B:
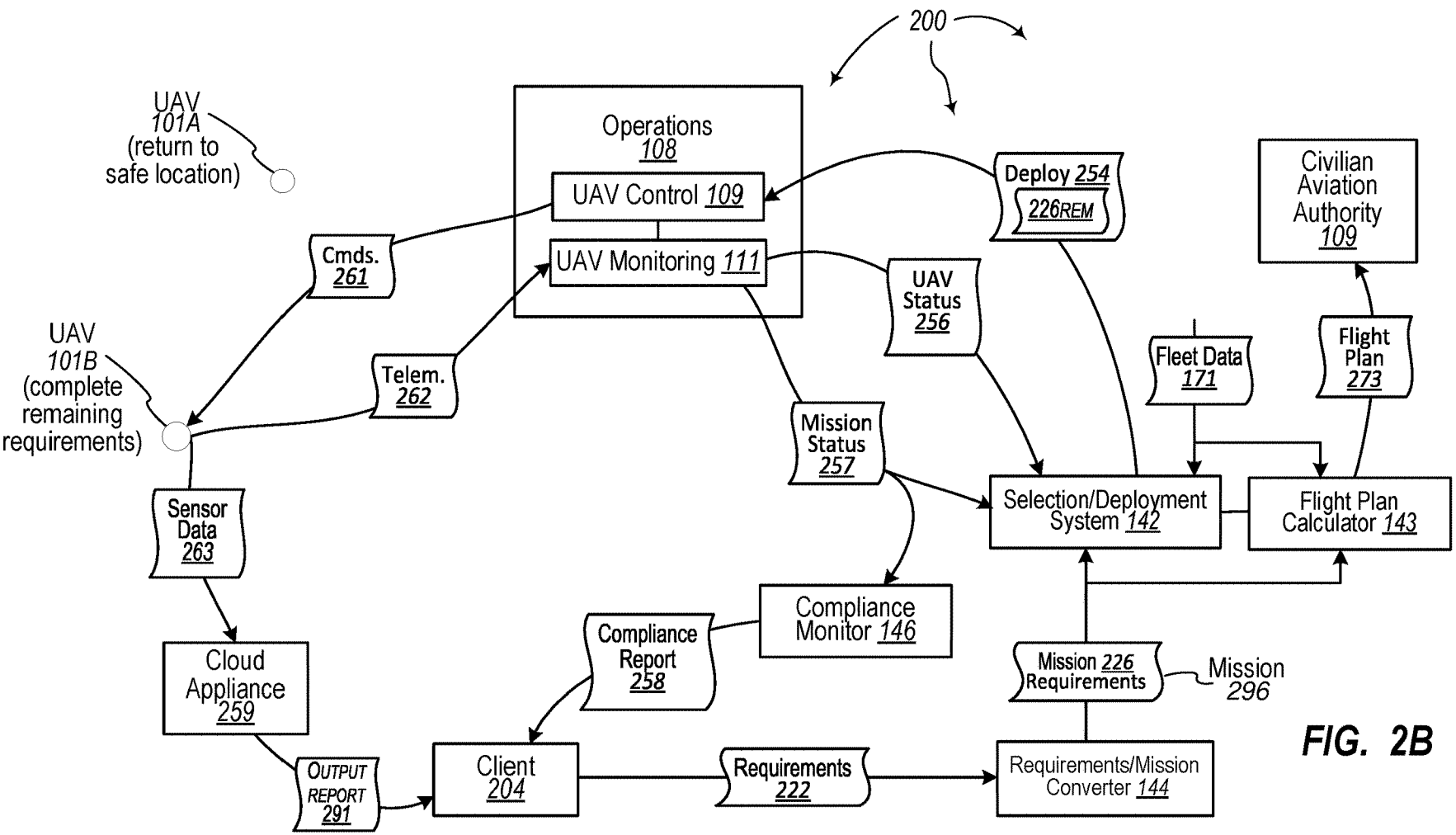

FIGS. 2A and 2B illustrates an example computer architecture 200 for deploying a replacement UAV from a fleet to satisfy the remainder of a request for UAV resources. In FIG. 2A, client 204 can send UAV resource requirements 222 to requirements/mission converter 144. Requirements/mission converter 144 can convert requirements 222 into a mission 296 having mission requirements 226.

Selection/Deployment system 142 can use the selection (matching) algorithm considering capabilities of available UAVs in fleet 101 (e.g., from fleet data 171) and mission requirements 226 (and with possible reference to mission cache 147 and weather data 127) to select UAV 101A to perform mission 296. UAV 101A may have minimal acceptable resources for performing mission 296 and is thus an optimized selection for mission 296 (i.e., resource utilization is maximized and resource wastage is minimized). Selection/Deployment system 142 can instruct flight plan calculator 143 to create and submit a flight plan for UAV 101A performing mission 296. In response, flight plan calculator 143 can create and submit flight plan 272 to civilian aviation authority 109.

Selection/Deployment system 142 can send deploy order 251, including mission requirements 226, to operations 108. Selection/Deployment system 142 and/or flight plan calculator 143 can also send flight plan 272 to operations 108. UAV control 109 can receive deploy order 251 and flight plan 272. In response to deploy order 251 and flight plan 272, UAV control 109 can send commands 229 to UAV 101A to deploy UAV 101A from UAV fleet 101. UAV 101A can be deployed into flight and instructed to perform mission 296 in accordance with flight plan 272 in order to satisfy mission requirements 226 (and thus at least a part of request 222).

During flight, UAV 101A can record sensor data 221 and submit sensor data 221 to cloud appliance 259. Sensor data 221 can be some but not all of the sensor data for satisfying mission requirements 226. On an ongoing basis while in flight, UAV 101A can send telemetry to UAV monitoring 111. For some amount of time, the telemetry can indicate that UAV 101A is airworthy. Subsequent to recording sensor data 221 (and while still in flight), UAV 101A can send telemetry 228 to operations 108. UAV monitoring 111 can receive telemetry 228. UAV monitoring 111 can process telemetry 228 to determine that UAV 101A is having a component failure related to airworthiness. UAV monitoring 111 can formulate UAV status 253 (failure) indicative of UAV 101A's component failure. UAV monitoring 111 can send UAV status 253 (failure) to Selection/Deployment system 142.

UAV monitoring 111 can also formulate mission status 252 based on UAV 101A's component failure. Mission status 252 can indicate that portions of mission 296 are incomplete due to UAV component failure. UAV monitoring 111 can send mission status 252 to Selection/Deployment system 142 and compliance monitor 146. Based on mission status 252, compliance monitor 146 can send compliance report 223 to client 204. Client 204 may or may choose to take action. For example, if there is still sufficient time to complete mission 296, client 204 may simply wait for further updates.

Turning to FIG. 2B, Selection/Deployment system 142 can use the selection (matching) algorithm considering capabilities of available UAVs in fleet 101 (e.g., from fleet data 171) and remaining mission requirements 226 (and with possible reference to mission cache 147 and weather data 127) to select UAV 101B as a replacement for UAV 101A. UAV 101B may or may not have been capable of collecting sensor data 221 (or performing parts of mission 296 previously performed by UAV 101A. However, UAV 101B can be capable of performing remaining portions of mission 296. UAV 101B may have minimal acceptable resources for performing remaining portions of mission 296 and is thus an optimized selection for the remaining portions of mission 296. Selection/Deployment system 142 can instruct flight plan calculator 143 to create and submit a flight plan for UAV 101B performing the remaining portions of mission 296. In response, flight plan calculator 143 can create and submit flight plan 273 to civilian aviation authority 109.

Selection/Deployment system 142 can send deploy order 255, including remaining mission requirements 226REM, to operations 108. Selection/Deployment system 142 and/or flight plan calculator 143 can also send flight plan 273 to operations 108. UAV control 109 can receive deploy order 254 and flight plan 273. In response, to deploy order 254 and flight plan 273, UAV control 109 can send commands 261 to deploy UAV 101B from UAV fleet 101. UAV 101B can be deployed into flight to perform remaining portions of mission 296 in accordance with flight plan 273 in order to satisfy remaining mission requirements 226REM (and thus at least a part of request 222).

During flight, UAV 101B can record sensor data 263 and submit sensor data 263 to cloud appliance 259. Sensor data 263 can include remaining sensor data for satisfying mission requirements 226. During and/or subsequent to recording sensor data 263 (and while still in flight and on an ongoing basis), UAV 101A can send telemetry 262 to operations 108. UAV monitoring 111 can receive telemetry 262. UAV monitoring 111 can process telemetry 262 to determine that UAV 101B operating within specified parameters and is airworthy. UAV monitoring 111 can formulate UAV status 256 indicative of UAV 101B's airworthiness. UAV monitoring 111 can send UAV status 256 to Selection/Deployment system 142.

UAV monitoring 111 can also formulate mission status 257 based on UAV 101B's airworthiness. Mission status 257 can indicate remaining portions of mission 296 have been completed. UAV monitoring 111 can send mission status 257 to Selection/Deployment system 142 and compliance monitor 146. Based on mission status 257, compliance monitor 146 can send compliance report 258 to client 204. compliance report 258 can indicate that mission 296 was completed.

In response to mission status 257, Selection/Deployment system 142 can instruct operations 108 to recall UAV 101B for maintenance/docking or retask UAV 101B. It may be that UAV 101B is (re)deployed in flight to complete another mission or part thereof.

Cloud appliance 259 can compile sensor data 221 and sensor data 263 into output report 291. Cloud appliance 259 can send output report 291 to client 204.

Figure 3:
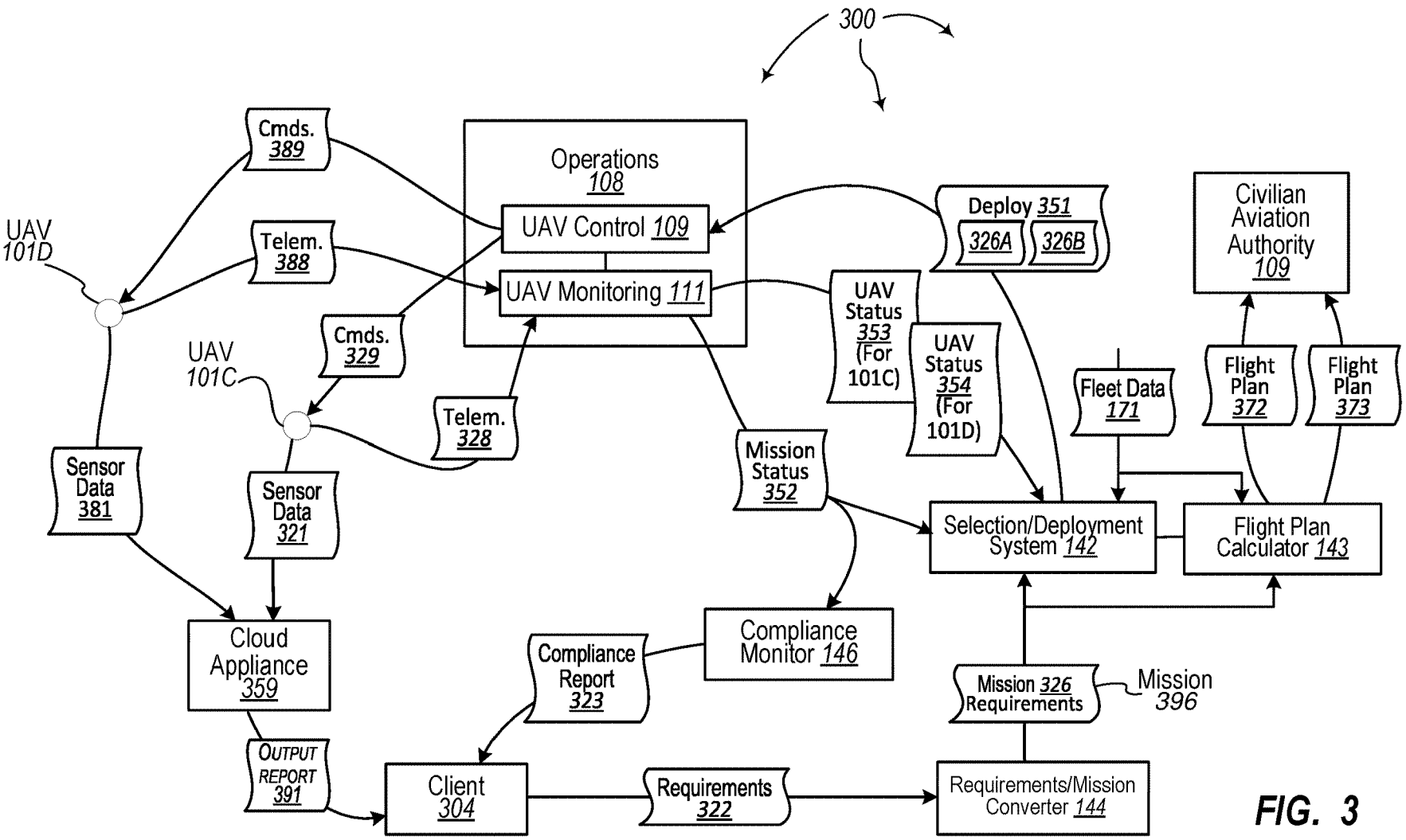
FIG. 3 illustrates an example computer architecture for deploying multiple UAVs from a fleet to satisfy a request for UAV resources.

FIG. 3 illustrates an example computer architecture 300 for deploying multiple UAVs from a fleet to satisfy a request for UAV resources. In FIG. 3, client 304 can send UAV resource requirements 322 to requirements/mission converter 144. Requirements/mission converter 144 can convert requirements 322 into a mission 396 having mission requirements 326.

Selection/Deployment system 142 can use the selection (matching) algorithm considering capabilities of available UAVs in fleet 101 (e.g., from fleet data 171) and mission requirements 326 (and with possible reference to mission cache 147 and weather data 127) to select UAVs 101C and 101D to perform mission 396. Selection/Deployment system 142 may determine that no single UAV in UAV fleet 101 has the capabilities to perform mission 396.

The combination UAVs 101C and 101D may have minimal acceptable resources for performing mission 396 and are thus an optimized selection for mission 396 (i.e., resource utilization is maximized and resource wastage is minimized). Selection/Deployment system 142 can instruct flight plan calculator 143 to create and submit flight plans for UAVs 101C and 101D performing mission 296. In response, flight plan calculator 143 can create and submit flight plans 372 (for UAV 101C) and 373 (for UAV 101D) to civilian aviation authority 109.

Selection/Deployment system 142 can send deploy order 351, including mission requirements 326A (for UAV 101C) and 326B (for UAV 101D) to operations 108. Mission requirements 326A and 326B represent different portions of mission requirements 326. Selection/Deployment system 142 and/or flight plan calculator 143 can also send flight plans 372 and 373 to operations 108. UAV control 109 can receive deploy order 251 and flight plans 372 and 373.

In response to deploy order 251 and flight plans 372 and 373, UAV control 109 can send commands 329 to UAV 101C to deploy UAV 101C from UAV fleet 101 and can send commands 389 to UAV 101D to deploy UAV 101D from UAV fleet 101. Deployment and operation of UAVs 101C and 101D in flight can be coordinated to perform mission 396 in accordance with flight plans 372 and 373 in order to satisfy mission requirements 326 (and thus at least a part of request 322).

During and/or subsequent to recording sensor data 321 (and while still in flight and on an ongoing basis), UAV 101C can send telemetry 328 to operations 108. UAV monitoring 111 can receive telemetry 328. Similarly, during and/or subsequent to recording sensor data 381 (and while still in flight and on an ongoing basis), UAV 101D can send telemetry 388 to operations 108. UAV monitoring 111 can receive telemetry 388. UAV monitoring 111 can process telemetry 328 to determine that UAV 101C is operating within specified parameters and is airworthy. Likewise, UAV monitoring 111 can process telemetry 328 to determine that UAV 101C is operating within specified parameters and is airworthy.

UAV monitoring 111 can formulate UAV status 353 indicative of UAV 101C's airworthiness. UAV monitoring 111 can send UAV status 353 to Selection/Deployment system 142. Similarly, UAV monitoring 111 can formulate UAV status 354 indicative of UAV 101D's airworthiness. UAV monitoring 111 can send UAV status 354 to Selection/Deployment system 142.

UAV monitoring 111 can also formulate mission status 352 based on UAV 101C's and UAV 101D's airworthiness. Mission status 352 can indicate mission 396 has been completed. UAV monitoring 111 can send mission status 352 to Selection/Deployment system 142 and compliance monitor 146. Based on mission status 352, compliance monitor 146 can send compliance report 323 to client 304. compliance report 323 can indicate that mission 396 was completed.

In response to mission status 352, Selection/Deployment system 142 can instruct operations 108 to recall UAV 101C and/or UAV 101D for maintenance/docking or retask UAV 101C and/or UAV 101D. It may be that one or both of UAVs 101C and 101D are (re)deployed in flight to complete another mission or part thereof.

Cloud appliance 359 can compile sensor data 321 and sensor data 381 into output report 391. Cloud appliance 359 can send output report 391 to client 304.

Figure 4:
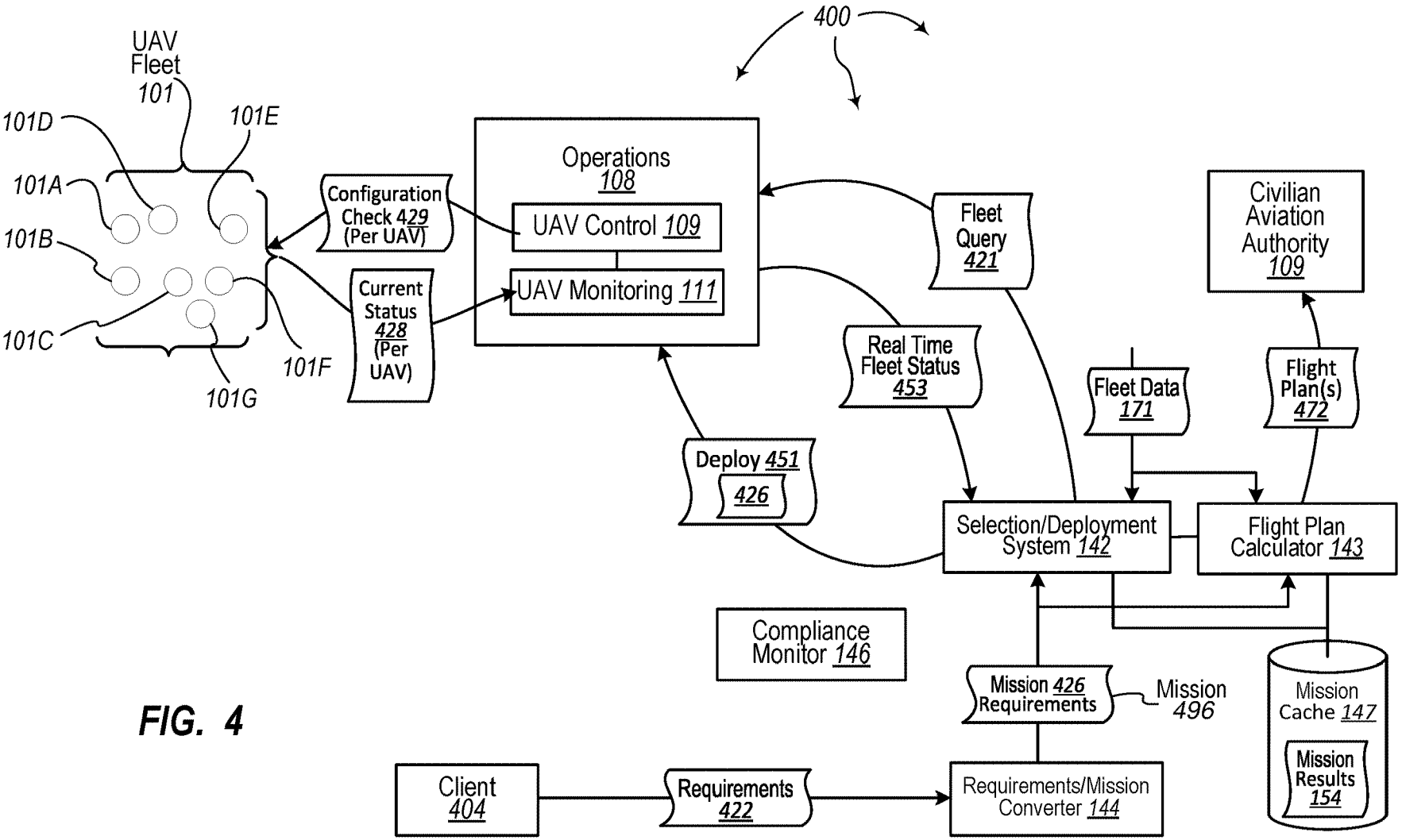
FIG. 4 illustrates an example computer architecture for deploying a UAV from a fleet to satisfy a request for UAV resources based on (essentially) real time fleet status information.

FIG. 4 illustrates an example computer architecture 400 for deploying a UAV from a fleet to satisfy a request for UAV resources based on (essentially) real time fleet status information. In FIG. 4, client 404 can send UAV resource requirements 422 to requirements/mission converter 144. Requirements/mission converter 144 can convert requirements 422 into a mission 496 having mission requirements 426.

Selection/Deployment system 142 can submit fleet query 421 to operations 108. In response to fleet query 421, UAV control 109 can perform a configuration check 429 per UAV in UAV fleet 101 (including UAVs on the ground as well as in flight). In response to a configuration check 429, each UAV can respond with a current status 428. UAV monitoring can transform the current status of the UAVs in UAV fleet 101 into (essentially) real time fleet status 453. Real time fleet status 453 can indicate any discrepancies between actual UAV resources available around the time mission 496 is received and UAV resources indicated in fleet data 171. For example, fleet data 171 can indicate that a UAV has two cameras. However, real time fleet status may indicate that one of the two cameras is inoperable.

Selection/Deployment system 142 can use the selection (matching) algorithm considering capabilities of available UAVs in fleet 101 (e.g., from fleet data 171), real time fleet status 453, and mission requirements 426 (and with possible reference to mission cache 147 and weather data 127) to select a UAV to perform mission 496. The selection (matching) algorithm can used real time fleet status avoid selecting a UAV that at one time was capable of performing mission 496 but is currently not capable of performing mission 496. Thus, Selection/Deployment system 142 can avoid using memory and processor resources to formulate a deploy command for a UAV having a significantly reduced likelihood of performing mission requirements 426. Further, Selection/Deployment system 142 can have a higher level of confidence in selecting a UAV for mission 496 that can perform mission requirements 426.

The selected UAV may have minimal acceptable resources for performing mission 496 from among UAVs in fleet 101 and is thus an optimized selection for mission 496 (i.e., resource utilization is maximized and resource wastage is minimized). Selection/Deployment system 142 can instruct flight plan calculator 143 to create and submit a flight plan the UAV performing mission 496. In response, flight plan calculator 143 can create and submit flight plan 472 to civilian aviation authority 109.

Selection/Deployment system 142 can send deploy order 451, with mission request 426, and possibly also flight plan 472 to operations 108. Operations 108 can deploy the UAV from UAV fleet 101 to perform mission 496.

Figure 5:
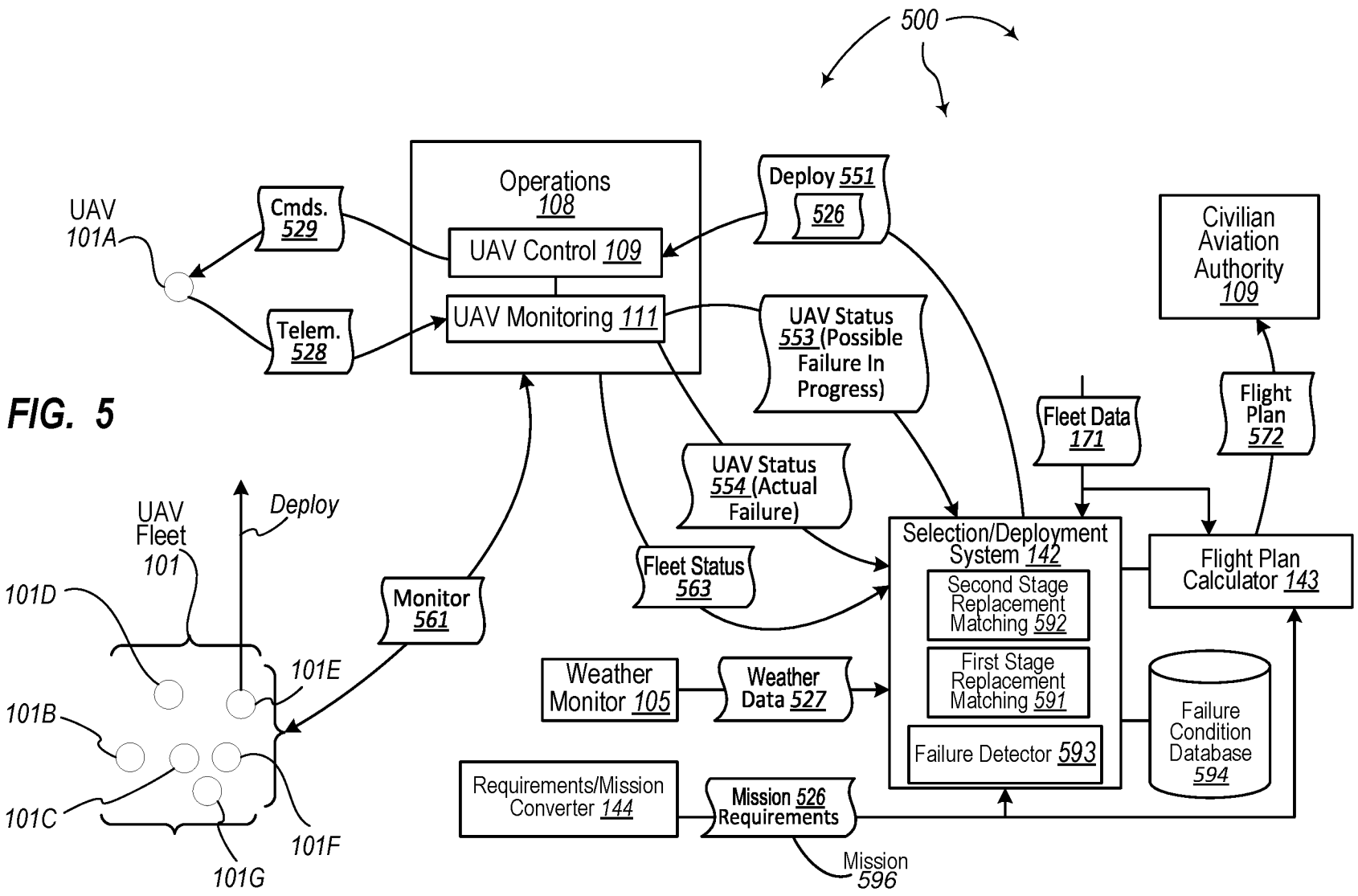
FIG. 5 illustrates an example computer architecture for predicting UAV failure in stages for a UAV deployed from a fleet and selecting a replacement UAV in stages.

FIG. 5 illustrates an example computer architecture 500 for predicting UAV failure in stages for a UAV deployed from a fleet and selecting a replacement UAV in stages. As depicted, computer architecture 500 incudes failure condition database 593. Failure condition database 594 can map UAV component status/failures/malfunctions to possible resulting UAV conditions due to the UAV component status/failures/malfunctions (including additional (cascading) UAV component failures/malfunctions). Failure condition database 593 can include a compilation of mappings based on prior UAV component failure/malfunctions and corresponding resulting UAV conditions. For example, if a rotor of a multi-rotor UAV is damaged (UAV component failure), lift and pitch attitude may degrade (resulting UAV condition). Failure condition database 594 can be connected to a network along with the other components of architecture 100.

UAV component status/failures/malfunctions can map to multiple different resulting UAV conditions. For some UAV component failure/malfunctions, UAV conditions are mutually exclusive. That is, a UAV component failure/malfunction may cause one resulting UAV condition from among a number of possible resulting UAV conditions. For other UAV component failure/malfunctions, UAV conditions are not mutually exclusive. That is, a UAV component failure/malfunction may cause one, some, or all of a number of possible resulting UAV conditions.

In some aspects, each possible resulting UAV condition is associated with a percentage indicating a likelihood of the UAV condition occurring in response to a corresponding UAV component status/failure/malfunction.

Requirements/mission converter 144 can convert received resource requirements into a mission 596 having mission requirements 526.

Selection/Deployment system 142 can use the selection (matching) algorithm considering capabilities of available UAVs in fleet 101 (e.g., from fleet data 171), weather data 527, fleet status 563, and mission requirements 526 (and with possible reference to mission cache 147) to select UAV 101A to perform mission 596. UAV 101A may have minimal acceptable resources for performing mission 596 and is thus an optimized selection for mission 596. Selection/Deployment system 142 can instruct flight plan calculator 143 to create and submit a flight plan for UAV 101A performing mission 596. In response, flight plan calculator 143 can create and submit flight plan 572 to civilian aviation authority 109.

Selection/Deployment system 142 can send deploy order 551, including mission requirements 526, to operations 108. Selection/Deployment system 142 and/or flight plan calculator 143 can also send flight plan 572 to operations 108. UAV control 109 can receive deploy order 551 and flight plan 572. In response to deploy order 551 and flight plan 572, UAV control 109 can send commands 529 to UAV 101A to deploy UAV 101A from UAV fleet 101. UAV 101A can be deployed into flight and instructed to perform mission 596 in accordance with flight plan 572 in order to satisfy mission requirements 526.

During flight, UAV 101A can send telemetry 528 to operations 108 on an ongoing basis. UAV monitoring 111 can detect UAV status 553 (possible failure in progress) from telemetry 528. UAV monitoring 111 can send UAV status 553 to Selection/Deployment system 142.

Failure detector 593 can locate UAV status 553 (or a similar status) in failure condition database 594. Failure detector 593 can consider possible resulting conditions (including possible cascading failures) associated with UAV status 553 (or the similar status). If they were to occur, some resulting conditions may impact the ability of UAV 101A to complete mission 596 (even if UAV 101A is otherwise operable) and other resulting conditions may not. As indicated in failure condition database 594, some resulting conditions may have a higher In one aspect, failure detector 593 alerts first stage replacement matching 591 when a UAV condition possibly resulting from UAV status 553 (or a similar status) has a first threshold likelihood (e.g., 10%) or greater of occurring and, if the condition were to occur, would impact the ability of UAV 101A to complete mission 596. In response to an alert from failure detector 593, first stage replacement matching 591 can perform preliminary aspects of a matching algorithm and store results in system memory. Preliminary aspects can include obtaining an updated fleet status 563, obtaining updated weather 527, performing matching with less than all possible variables to select a subset of UAVs in UAV fleet 101, instructing temporarily more robust monitoring 561 of UAV fleet 101, etc.

Preliminary aspects can also include taking preliminary actions to identify and prepare a potential replacement UAV. For example, selection/deployment system can identify and prepare potential replacement UAV 101E. For example, potential replacement UAV 101E can be powered up, safety check performed, placed on ready standby, fitted with appropriate sensors, etc.

UAV 101A can continue to send telemetry 528 to operations 108 on an ongoing basis. UAV monitoring 111 can monitor telemetry 528 and update selection/deployment system 142 on the status of UAV 101A as appropriate.

If no escalation (worsening) of status for UAV 101A occurs after a specified period of time (e.g., 2-30 minutes or possibly through to mission completion), results of preliminary matching can be cleared form system memory. Additionally, preliminary actions to ready potential replacement UAV 101E can be rolled backed. For example, potential replacement UAV 101E can be powered down, removed from ready standby, sensors removed, etc.

On the other hand, if escalation (worsening) of status for UAV 101A does occur, results of preliminary matching can be accessed from system memory and used to complete selection of replacement UAV 101E to replace UAV 101A. For example, subsequent to UAV status 553, UAV monitoring 111 can detect UAV status 554 (actual failure) from telemetry 528. UAV monitoring 111 can send UAV status 554 to Selection/Deployment system 142.

In response to the actual failure indicated in UAV status 554, second stage replacement matching 592 can access results of preliminary matching from system memory. Second stage replacement matching 592 can use the results of preliminary matching with any other described data (and with possible reference to mission cache 147) to select UAV 101E as an actual replacement for UAV 101A.

Selection/Deployment system 142 can instruct flight plan calculator 143 to create and submit a flight plan for UAV 101E and send a deploy order to operations 108. Since some preliminary actions were already performed to prepare UAV 101E, selection/deployment system 142 can complete the deployment of UAV 101E more quickly in response to UAV status 554.

The stages of deployment for a potential replacement UAV can correspond to (or match) the stages of failure for a deployed UAV. The closer a deployed UAV is to failure the more actions can be taken to prepare a potential replacement UAV. Having deployment stages correspond to failure stages balances the countervailing goals of resource consumption and quicker deployment of replacement UAVs. Resource consumption can generally track the probability of actual failure.

It makes little sense to take significant preparatory actions for a potential replacement UAV when there is little chance of actual failure. For example, if a deployed UAV has a 5%-15% chance of actual failure, powering up, safety checking, changing a sensor, generating a new flight plan, and flying a potential replacement UAV to the location of the deployed UAV can unnecessarily consume resources. If no escalation occurs, resources of potential replacement UAV are essentially wasted and removed as an option for other missions.

On the other hand, it also makes little sense to wait on preparatory actions until failure is a virtual certainty. For example, if a deployed UAV has an 85% or greater chance of actual failure, powering up a potential replacement UAV but taking no other action can undesirably cost time. If escalation to actual failure subsequently occurs, significant time may be consumed to perform addition preparatory actions for the replacement UAV can be deployed. This delays deployment possibly causing SLAs to go unmet.

In another aspect, failure detector 593 directly alerts second stage replacement matching 592 when a UAV condition possibly resulting from UAV status 553 (or a similar status) has a second threshold likelihood (e.g., 50%) or greater of occurring and, if the condition were to occur, would impact the ability of UAV 101A to complete mission 596. The second threshold can be higher than the first threshold.

In response to an alert from failure detector 593, second stage replacement matching 592 can use the selection (matching) algorithm considering capabilities of available UAVs in fleet 101 (e.g., from fleet data 171), fleet status 563, weather data 527, and remaining mission requirements 526 (and with possible reference to mission cache 147 and weather data 127) to select UAV 101E as a replacement for UAV 101A. Selection/Deployment system 142 can instruct flight plan calculator 143 to create and submit a flight plan for USV 101E and sent a deploy order to operations 108.

Accordingly, Selection/Deployment system 142 can use computing and memory resources in stages and balanced against the likelihood of a condition impacting a UAV's ability to complete a mission actually occurring. For example, Selection/Deployment system 142 would refrain from using a greater amount of computing and memory resources to fully select a replacement UAV, when a UAV status at a current UAV has a relatively low chance of mission impact. However, Selection/Deployment system 142 may use a lesser amount of resources to store a subset of possible replacement UAVs in system memory such that the subset can be more quickly accessed when a condition impacting a mission does occur. Resources are efficiently utilized and resource waste is minimized (e.g., waste may occur when resources are used to fully select replacement UAV but the replacement UAV is not deployed because status at a current UAV does not escalate).

Additional matching stages of failure and deployment can be included in Selection/Deployment system 142 to more precisely balance resource usage against the possibility of a UAV status/failure/malfunction causing a UAV condition that impacts the ability of a UAV to complete a mission.

Figure 6:
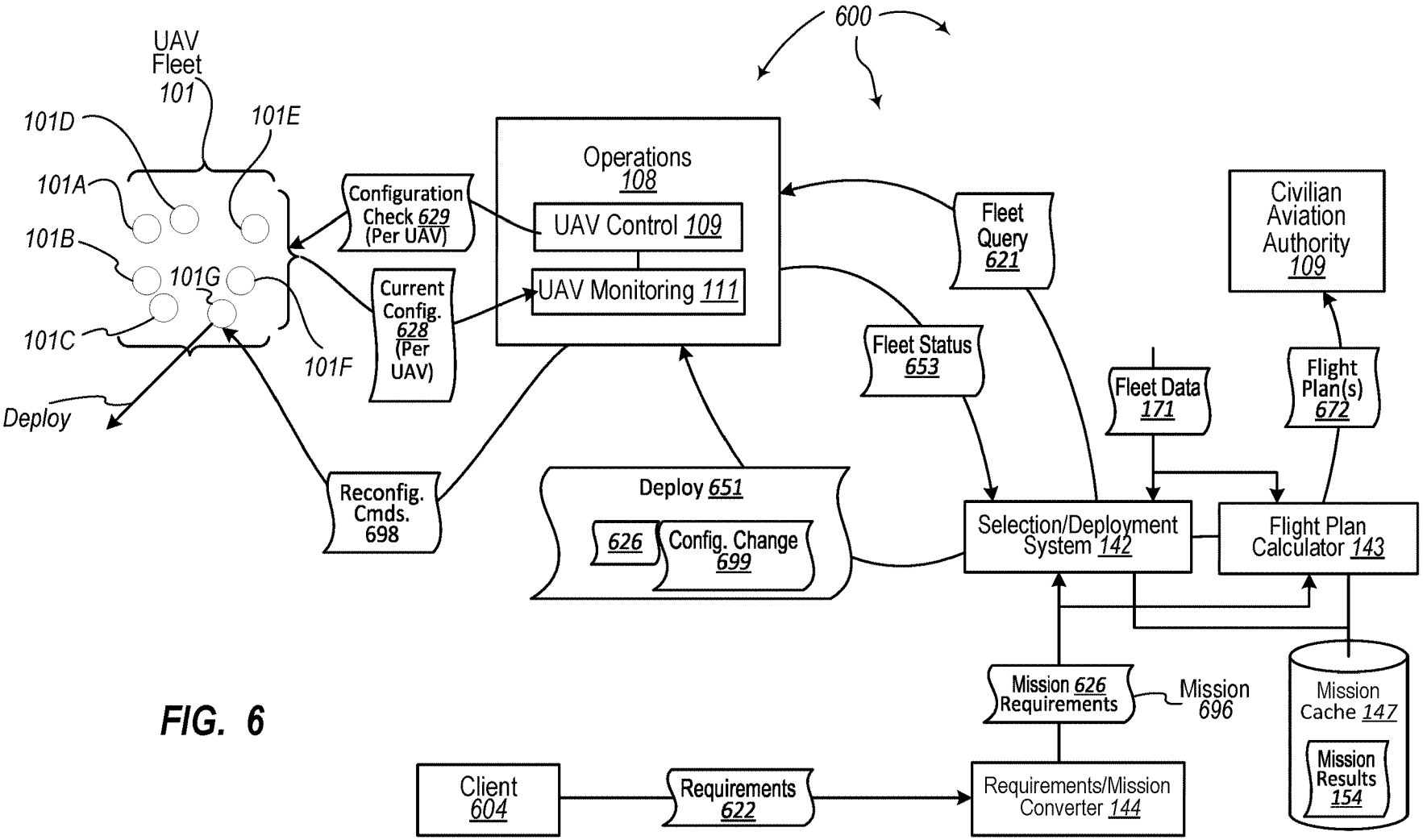
FIG. 6 illustrates an example computer architecture for deploying a UAV from a fleet with a configuration change to satisfy a request for UAV resources.

FIG. 6 illustrates an example computer architecture 600 for deploying a UAV from a fleet with a configuration change to satisfy a request for UAV resources. In FIG. 6, client 604 can send UAV resource requirements 622 to requirements/mission converter 144. Requirements/mission converter 144 can convert requirements 622 into a mission 696 having mission requirements 626.

Selection/Deployment system 142 can submit fleet query 621 to operations 108. In response to fleet query 621, UAV control 108 can perform a configuration check 629 per UAV in UAV fleet 101 (including UAVs on the ground as well as in flight). In response to a configuration check 629, each UAV can respond with a current status 628. UAV monitoring can transform the current status of the UAVs in UAV fleet 101 into (essentially) real time fleet status 653. Real time fleet status 653 can indicate the current configurations of UAVs in UAV fleet 101 as well as any discrepancies between actual UAV resources available around the time mission 696 is received and UAV resources indicated in fleet data 171.

A UAV may have multiple different possible configurations indicated in fleet data 171, real time fleet status 653 can indicate that the UAV is in one of those multiple different configurations. For example, a UAV may have different battery settings. A first setting may permit quicker acceleration and a higher top speed. A second setting may limit acceleration and have a lower top speed. However, the first setting may drain the battery quicker than the second setting. The first setting may be preferred for a pursuit mission while the second setting is performed for a longer duration mission. Multiple configurations for other UAV components is also possible.

Selection/Deployment system 142 can use the selection (matching) algorithm considering capabilities and possible configurations of available UAVs in fleet 101 (e.g., from fleet data 171), current UAV configurations indicated in real time fleet status 653, and mission requirements 626 (and with possible reference to mission cache 147 and weather data 127) to select a UAV 101G to perform mission 696. The selection (matching) algorithm can use real time fleet status 653 to consider UAVs that can change configurations to become capable of performing mission 696. Thus, Selection/Deployment system 142 can more precisely select UAV 1010G as a UAV with minimum resources for performing mission requirements 626.

Selection/Deployment system 142 can instruct flight plan calculator 143 to create and submit a flight plan for UAV 101G to perform mission 696. In response, flight plan calculator 143 can create and submit flight plan 672 to civilian aviation authority 109. Selection/Deployment system 142 can send deploy order 651, with mission requirements 626, configuration change 699, and possibly also flight plan 672 to operations 108.

In response to deploy order 561, operations 108 can transform configuration change 699 into reconfiguration commands 698. Operations 108 can send reconfiguration commands 698 to UAV 101G to change the configuration of UAV 101G. After the configuration change, UAV control 109 can send commands to UAV 101G to deploy UAV 101G from UAV fleet 101. UAV 101G can be deployed into flight and instructed to perform mission 696 in accordance with flight plan 672 in order to satisfy mission requirements 626 (and thus at least a part of request 622).

In one aspect, modules of operations 108 and UAV resource allocator 141 are included in the same computer system and/or in the same physical location. In other aspects, operations 108 and UAV resource allocator 141 are in different computer systems and/or in different physical locations. Operations 108 and UAV resource allocator 141 may be under the control of the same or different entities.

Failure to satisfy a resource request (e.g., an SLA) may result in a consequence (e.g., a financial penalty) for a service provider. In one aspect, UAV service providers having agreements permitting service providers to deploy one another's UAVs. If a service provider lacks UAV resources to satisfy a UAV resource request, the service provider may consider UAVs of other service providers. It may be cheaper to deploy a UAV from another service provider than face a consequence for failure to satisfy a resource request.

Matching UAVs to mission requirements and calculating flight plans across a fleet of UAVs can be computational intensive and utilize relatively substantial memory, storage, and processing resources. Any mechanisms that reduce computing resource usage and/or distribute/balance compute resource usage over time can improve the operation of a computer system.

UAV resource allocator 141 can include a user interface for managing UAV fleet 101. In one aspect, UAV resource allocator 141 has a number of connected terminals each including a user interface for managing UAV fleet 101. The user interface can include visualization tools within UAV resource allocator 141 be used to instantly convey the status of a mission as well as individual mission requirements, including any change requests. Such tools may be used in many different areas, such as interactive displays within UAV resource allocator 141 as well as messages or other items that contain mission information.

The status of a UAV mission can be illustrated by a series of icons that represent the lifecycle of the mission. Each icon may have a status indicator that may visually show the status of the mission. Since a mission or may have a current phase and status, an icon representing a completed stage or a stage yet to be completed may be shown with the current status of the current phase icon. Completed and future stages may be illustrated with grayed-out icons or icons with a different color to differentiate from the current phase and status.

In some aspects, a status indicator may be interactive, allowing a user to mouse over, click on, right click, or otherwise interact with the status indicator to perform certain functions that may be available or to display underlying data or for other actions.

The status of multiple missions may be illustrated by showing various missions and relationships between the missions (e.g., multiple missions related to the same SLA). The relationships may be one way or two way relationships between missions, in addition to sequential, parallel, peer to peer, parent/child, or other relationships. In some cases, such a display may be interactive, enabling a user to view, edit, or otherwise interact with missions or relationships as independent entities or as groups of entities.

Figure 7:
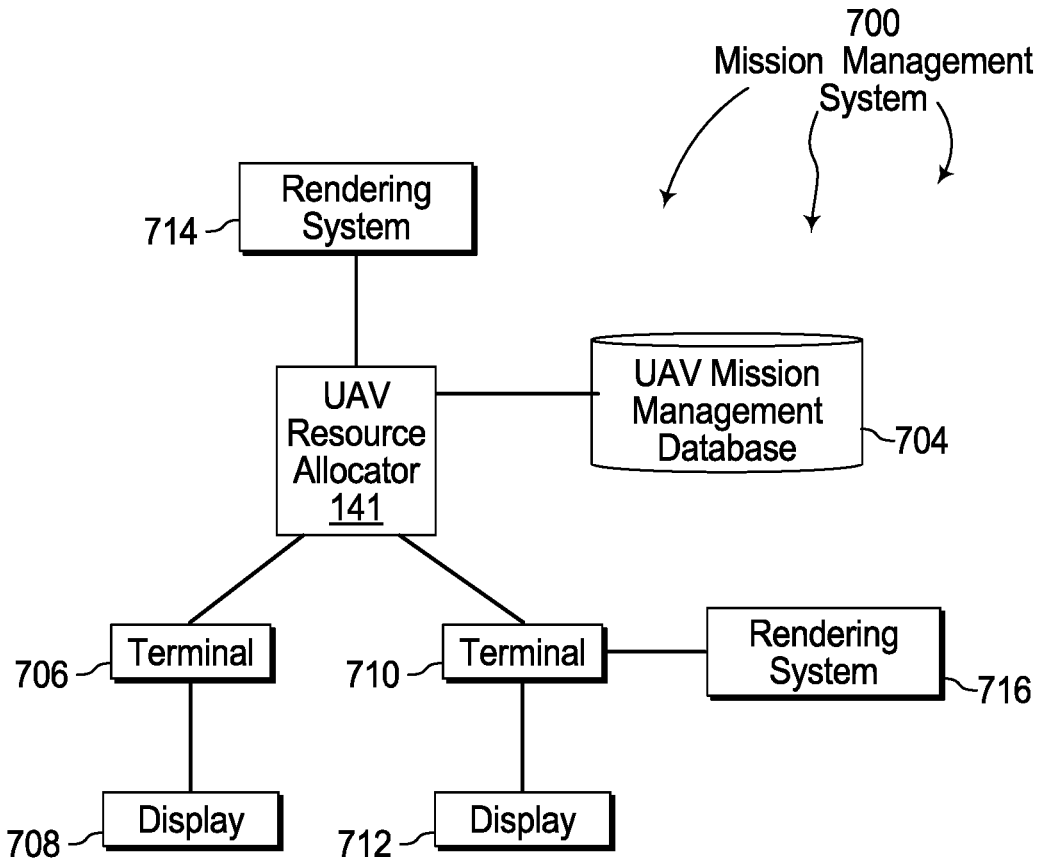
FIG. 7 illustrates an example computer architecture facilitating UAV mission management.

FIG. 7 illustrates an example computer architecture for a mission management system 700. Mission management system 700 may be used manage mission and mission changes in an information technology or other application. A mission management system may be used to change mission requirements, approve mission requirements, manage changes to mission requirements during a mission, provide review of completed missions (e.g., compliance reports), etc. In some cases, missions may be linked together. For example, a sequential relationship may be defined between two missions so that one mission is performed before another (e.g., one UAV preps for work to be done by another UAV).

For service providers with large UAV fleets and many SLAs, the number of missions and changing mission requirements may be very large. In order to effectively communicate mission status and the interrelationships between missions and mission changes, various visual representations may be used. One example may be a set of sequential status icons that are arranged in order of phases of a lifecycle of a mission. Each of the icons may represent one phase of the lifecycle and may have an indicator for the current status within the phase. Such a visual representation may help a user quickly grasp the current status for an individual mission.

Another example of a visual representation may be a graphical view of missions and the relationships between missions. Multiple missions may be viewed in such a representation, and, in some cases, interactive features on the representation may enable a user to perform various actions directly from the visual representation. Examples of such actions may be to display additional details, edit underlying data, or other functions.

The mission management system 700 may be configured in many different manners. In one aspect, a client server architecture includes UAV resource allocator 141 that interfaces with a UAV mission management database 704. Multiple clients 706 and 710 may interface with UAV resource allocator 141. Client 706 may have a display device 708. Similarly, client 710 may have a display device 712.

In some aspects, a client may interface with UAV resource allocator 141 by running an application on a client device. The application may communicate with UAV resource allocator 141 to transfer data to and from UAV mission management database 704. In such a case, rendering system 716 may be operable on client 710 to analyze mission management data and create visual representations of the data.

In other instances, a client may interface with the UAV resource allocator 741 by running a thin client, browser, or other architecture whereby the UAV resource allocator 741 may perform many of the functions of the overall system. In such an instance, client device 706 may use a web browser to send and receive information to a mission management application that operates on UAV resource allocator 741. Many of the functions of a mission management application may be performed on UAV resource allocator 741 in such a case, such as having rendering system 714 that may create visual representations that are transferred to client 706 and displayed on display device 708.

Many different architectures are possible for a mission management system. Some systems may have some functions that are performed on a client device while other functions may be performed by a UAV resource allocator. In some systems, a single computing device may perform all of the mission management functions.

In some embodiments, UAV resource allocator 141 and clients 706 and 710 may be connected by a local area network. In other embodiments, one or both of the clients 706 or 710 may access UAV resource allocator 141 through an internet connection or other wide area network. In some cases, UAV resource allocator 141 may provide a mission management service that is accessible through a web browser as a web service.

Remotely operated aerial vehicles can include computer network connectivity components (e.g., a Network Interface Card ("NIC') or cellular modem) for wired or wirelessly connecting the monitoring equipment to a computer network. As such, modules, algorithms, components, etc., for providing landing guidance for remotely operated aerial vehicles using crossed radar beams can also be connected to other modules, algorithms, components, etc., over (or be part of) a network, such as, for example, a Local Area Network ("LAN"), a Wide Area Network ("WAN"), and even the Internet. Accordingly, the modules, algorithms, components, etc., for providing landing guidance for remotely operated aerial vehicles using crossed radar beams as well as any other connected computer systems and their components (e.g., in a control or command center), can create message related data and exchange message related data (e.g., Internet Protocol ("IP") datagrams and other higher layer protocols that utilize IP datagrams, such as, Transmission Control Protocol ("TCP"), Hypertext Transfer Protocol ("HTTP"), Simple Mail Transfer Protocol ("SMTP"), etc. or using other non-datagram protocols) over the network.

Aspects of the present invention may comprise or utilize a special purpose or general-purpose computer including computer hardware, such as, for example, one or more processors and system memory, as discussed in greater detail below. Aspects within the scope of the present invention also include physical and other computer-readable media for carrying or storing computer-executable instructions and/or data structures. Such computer-readable media can be any available media that can be accessed by a general purpose or special purpose computer system. Computer-readable media that store computer-executable instructions are computer storage media (devices). Computer-readable media that carry computer-executable instructions are transmission media. Thus, by way of example, and not limitation, Aspects of the invention can comprise at least two distinctly different kinds of computer-readable media: computer storage media (devices) and transmission media.

Computer storage media (devices) includes RAM, ROM, EEPROM, CD-ROM, solid state drives ("SSDs") (e.g., based on RAM), Flash memory, phase-change memory ("PCM"), other types of memory, other optical disk storage, magnetic disk storage or other magnetic storage devices, or any other medium which can be used to store desired program code means in the form of computer-executable instructions or data structures and which can be accessed by a general purpose or special purpose computer.

A "network" is defined as one or more data links that enable the transport of electronic data between computer systems and/or modules and/or other electronic devices. When information is transferred or provided over a network or another communications connection (either hardwired, wireless, or a combination of hardwired or wireless) to a computer, the computer properly views the connection as a transmission medium. Transmissions media can include a network and/or data links which can be used to carry desired program code means in the form of computer-executable instructions or data structures and which can be accessed by a general purpose or special purpose computer. Combinations of the above should also be included within the scope of computer-readable media.

Further, upon reaching various computer system components, program code means in the form of computer-executable instructions or data structures can be transferred automatically from transmission media to computer storage media (devices) (or vice versa). For example, computer-executable instructions or data structures received over a network or data link can be buffered in RAM within a network interface module (e.g., a "NIC"), and then eventually transferred to computer system RAM and/or to less volatile computer storage media (devices) at a computer system. Thus, it should be understood that computer storage media (devices) can be included in computer system components that also (or even primarily) utilize transmission media.

Computer-executable instructions comprise, for example, instructions and data which, when executed at a processor, cause a general purpose computer, special purpose computer, or special purpose processing device to perform a certain function or group of functions. The computer executable instructions may be, for example, binaries, intermediate format instructions such as assembly language, or even source code. Although the subject matter has been described in language specific to structural features and/or methodological acts, it is to be understood that the subject matter defined in the appended claims is not necessarily limited to the described features or acts described above. Rather, the described features and acts are disclosed as example forms of implementing the claims.

Those skilled in the art will appreciate that the invention may be practiced in network computing environments with many types of computer system configurations, including, personal computers, desktop computers, laptop computers, message processors, hand-held devices, multi-processor systems, microprocessor-based or programmable consumer electronics, network PCs, minicomputers, mainframe computers, mobile telephones, PDAs, tablets, pagers, routers, switches, and the like. The invention may also be practiced in distributed system environments where local and remote computer systems, which are linked (either by hardwired data links, wireless data links, or by a combination of hardwired and wireless data links) through a network, both perform tasks. In a distributed system environment, program modules may be located in both local and remote memory storage devices.

Aspects of the invention can also be implemented in cloud computing environments. In this description and the following claims, "cloud computing" is defined as a model for enabling on-demand network access to a shared pool of configurable computing resources. For example, cloud computing can be employed in the marketplace to offer ubiquitous and convenient on-demand access to the shared pool of configurable computing resources. The shared pool of configurable computing resources can be rapidly provisioned via virtualization and released with low management effort or service provider interaction, and then scaled accordingly.

A cloud computing model can be composed of various characteristics such as, for example, on-demand self-service, broad network access, resource pooling, rapid elasticity, measured service, and so forth. A cloud computing model can also expose various service models, such as, for example, Software as a Service ("SaaS"), Platform as a Service ("PaaS"), and Infrastructure as a Service ("IaaS"). A cloud computing model can also be deployed using different deployment models such as private cloud, community cloud, public cloud, hybrid cloud, and so forth. In this description and in the claims, a "cloud computing environment" is an environment in which cloud computing is employed.

In one aspect, one or more processors are configured to execute instructions (e.g., computer-readable instructions, computer-executable instructions, etc.) to perform any of a plurality of described operations. The one or more processors can access information from system memory and/or store information in system memory. The one or more processors can transform information between different formats, such as, for example, resource requirements, resource requests, mission requirements, mission results, mission cache, flight pans, fleet data, deployment orders, mission status, UAV status, UAV commands, UAV telemetry, weather data, sensors data, output reports, compliance reports, fleet queries, (essentially) real time fleet status, configuration checks, current status, failure detector alerts, failure condition database data, mappings of UAV status/failures/malfunctions to possible resulting UAV conditions, partial matching results, configuration changes, reconfiguration commands, etc.

System memory can be coupled to the one or more processors and can store instructions (e.g., computer-readable instructions, computer-executable instructions, etc.) executed by the one or more processors. The system memory can also be configured to store any of a plurality of other types of data generated and/or transformed by the described components, such as, for example, resource requirements, resource requests, mission requirements, mission results, mission cache, flight pans, fleet data, deployment orders, mission status, UAV status, UAV commands, UAV telemetry, weather data, sensors data, output reports, compliance reports, fleet queries, (essentially) real time fleet status, configuration checks, current status, failure detector alerts, failure condition database data, mappings of UAV status/failures/malfunctions to possible resulting UAV conditions, partial matching results, configuration changes, reconfiguration commands, etc.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed:

1. A system, the system comprising:

one or more processors;

system memory coupled to the one or more processors, the system memory storing instructions that are executable by the one or more processors;

a fleet of Unmanned Aerial Vehicles, the fleet of Unmanned Aerial Vehicles including a plurality of Unmanned Aerial Vehicles; and the one or more processors executing the instructions stored in the system memory to optimize deployment of Unmanned Aerial Vehicle resources from the fleet to satisfy requests for Unmanned Aerial Vehicle resources, including the following:

receive Unmanned Aerial Vehicle resource requirements from a client;

convert the Unmanned Aerial Vehicle resource requirements to a mission having one or more mission requirements;

select an Unmanned Aerial Vehicle, from among the fleet of Unmanned Aerial Vehicles, to perform the mission by considering the capabilities of each available Unmanned Aerial Vehicle in the fleet of Unmanned Aerial Vehicles relative to the one or more mission requirements to select the Unmanned Aerial Vehicle having minimal acceptable resources for performing the one or more requirements;

instruct a flight plan calculator to calculate a flight plan for the Unmanned Aerial Vehicle and submit the flight plan to a civilian aviation authority;

send a deploy order to deploy the Unmanned Aerial Vehicle into flight to perform the mission in accordance with the flight plan to satisfy the one or more mission requirements;

after the deployment of the Unmanned Aerial Vehicle and while the performance of the mission by the Unmanned Aerial Vehicle is in progress, receive a status of the Unmanned Aerial Vehicle;

in response to receiving the status, refer to a failure condition database to calculate a possibility of the Unmanned Aerial Vehicle developing a condition inhibiting the ability of the Unmanned Aerial Vehicle to complete the mission based on the received status;

determine that the possibility of the Unmanned Aerial Vehicle developing the condition satisfies a first threshold;

perform preliminary aspects of selecting a replacement Unmanned Aerial Vehicle in response to the determination; and store results of performing preliminary aspects of selecting a replacement Unmanned Aerial Vehicle in system memory.

2. The system of claim 1, wherein the one or more processors executing the instructions stored in the system memory to receive Unmanned Aerial Vehicle resource requirements from a client comprises the one or more processors executing the instructions stored in the system memory to receive Unmanned Aerial Vehicle resource requirements specifying one or more of: particular Unmanned Aerial Vehicle resources or particular types of Unmanned Aerial Vehicle resources.

3. The system of claim 1, wherein the one or more processors executing the instructions stored in the system memory to receive a status of the Unmanned Aerial Vehicle comprises the one or more processors executing the instructions stored in the system memory to receive a status indicative of the Unmanned Aerial Vehicle being unable to complete the mission and leaving at least one remaining mission requirement unsatisfied, the at least one remaining mission requirement from among the one or more mission requirements; and wherein the one or more processors executing the instructions stored in the system memory to perform preliminary aspects of selecting a replacement Unmanned Aerial Vehicle comprises the one or more processors executing the instructions stored in the system memory to select the replacement Unmanned Aerial Vehicle, from among the fleet of Unmanned Aerial Vehicles, to perform the at least one remaining mission requirement by considering the capabilities of each available Unmanned Aerial Vehicle in the fleet of Unmanned Aerial Vehicles relative to the at least one remaining mission requirement to select the replacement Unmanned Aerial Vehicle having minimal acceptable resources for performing the at least one remaining mission requirement; the system further comprising the one or more processors executing the instructions stored in the system memory to:

instruct the flight plan calculator to calculate an additional flight plan for the replacement Unmanned Aerial Vehicle and submit the additional flight plan to a civilian aviation authority; and send another deploy order to deploy the replacement Unmanned Aerial Vehicle into flight to perform the at least one remaining mission requirement in accordance with the additional flight plan to satisfy the at least one remaining mission requirement.

4. The system of claim 1, further comprising the one or more processors executing the instructions stored in the system memory to:

sending a fleet query to an Unmanned Aerial Vehicle operation center;

receiving a real time fleet status for the fleet of Unmanned Aerial Vehicles from the Unmanned Aerial Vehicle operation center; and wherein the one or more processors executing the instructions stored in the system memory to select an Unmanned Aerial Vehicle, from among the fleet of Unmanned Aerial Vehicles, to perform the mission comprises the one or more processors executing the instructions stored in the system memory to select an Unmanned Aerial Vehicle by considering the real time fleet status.

5. The system of claim 1, wherein the one or more processors executing the instructions stored in the system memory to receive Unmanned Aerial Vehicle resource requirements from a client comprises the one or more processors executing the instructions stored in the system memory to receive Unmanned Aerial Vehicle resource requirements to capture images with a sensor attached to the Unmanned Aerial Vehicle.

6. The system of claim 1, wherein the one or more processors executing the instructions stored in the system memory to receive Unmanned Aerial Vehicle resource requirements from a client comprises the one or more processors executing the instructions stored in the system memory to receive Unmanned Aerial Vehicle resource requirements to deliver a package.

7. The system of claim 1, wherein the one or more processors executing the instructions stored in the system memory to select an Unmanned Aerial Vehicle, from among the fleet of Unmanned Aerial Vehicles, to perform the mission comprises the one or more processors executing the instructions stored in the system memory to select an Unmanned Aerial Vehicle that can be re-configured from a current configuration to a new configuration to perform the mission; and wherein the one or more processors executing the instructions stored in the system memory to send a deploy order to deploy the Unmanned Aerial Vehicle comprises the one or more processors executing the instructions stored in the system memory to send a deploy order including a configuration change, the configuration command for transitioning the Unmanned Aerial Vehicle to the new configuration prior to deployment.

8. The system of claim 1, further comprising the one or more processors executing the instructions stored in the system memory to:

fail to receive a further status indicating escalation of a condition at the Unmanned Aerial Vehicle prior to completion of the mission; and clearing results of performing preliminary aspects of selecting a replacement Unmanned Aerial Vehicle from system memory.

9. The system of claim 1, further comprising the one or more processors executing the instructions stored in the system memory to:

receive a further status indicating escalation (worsening) of the condition at the Unmanned Aerial Vehicle prior to completion of the mission; and retrieve the results of performing preliminary aspects of selecting a replacement Unmanned Aerial Vehicle from system memory; and utilize the results to select a replacement Unmanned Aerial Vehicle, from among the fleet of Unmanned Aerial Vehicles, to perform at least one remaining mission requirement by considering the capabilities of each available Unmanned Aerial Vehicle in the fleet of Unmanned Aerial Vehicles relative to the at least one remaining mission requirement.

10. The system of claim 1, further comprising the one or more processors executing the instructions stored in the system memory to:

receive a further status indicating escalation (worsening) of the condition at the Unmanned Aerial Vehicle prior to completion of the mission;

determine that the possibility of the Unmanned Aerial Vehicle developing the condition satisfies a second threshold, greater than the first threshold;

retrieve the results of performing preliminary aspects of selecting the replacement Unmanned Aerial Vehicle from the system memory;

perform second stage aspects of selecting the replacement Unmanned Aerial Vehicle in response to the determination; and store results of performing the second stage aspects of selecting the replacement Unmanned Aerial Vehicle in the system memory.

11. A system, the system comprising:

one or more processors;

system memory coupled to the one or more processors, the system memory storing instructions that are executable by the one or more processors;

a fleet of Unmanned Aerial Vehicles, the fleet of Unmanned Aerial Vehicles including a plurality of Unmanned Aerial Vehicles; and the one or more processors executing the instructions stored in the system memory to optimize deployment of Unmanned Aerial Vehicle resources from the fleet to satisfy requests for Unmanned Aerial Vehicle resources, including the following:

receive first Unmanned Aerial Vehicle resource requirements from a first client;

convert the first Unmanned Aerial Vehicle resource requirements to a first mission having a first one or more mission requirements;

receive second Unmanned Aerial Vehicle resource requirements from a second client;

convert the second Unmanned Aerial Vehicle resource requirements to a second mission having a second one or more mission requirements;

select an Unmanned Aerial Vehicle, from among the fleet of Unmanned Aerial Vehicles, to perform both the first mission and the second mission by considering the capabilities of each available Unmanned Aerial Vehicle in the fleet of Unmanned Aerial Vehicles relative to the one or more mission requirements to select the Unmanned Aerial Vehicle having minimal acceptable resources for performing both the first one or more mission requirements and the second one or more mission requirements;

instruct a flight plan calculator to calculate a flight plan for the Unmanned Aerial Vehicle and submit the flight plan to a civilian aviation authority;

send a deploy order to deploy the Unmanned Aerial Vehicle into flight to perform the first mission and the second mission in accordance with the flight plan to satisfy the first one or more mission requirements and the second one or more mission requirements;

after the deployment of the Unmanned Aerial Vehicle and while the performance of at least one of the first mission and the second mission by the Unmanned Aerial Vehicle is in progress, receive a status of the Unmanned Aerial Vehicle;

in response to receiving the status, refer to a failure condition database to calculate a possibility of the Unmanned Aerial Vehicle developing a condition inhibiting the ability of the Unmanned Aerial Vehicle to complete at least one of the first mission and the second mission based on the received status;

determine that the possibility of the Unmanned Aerial Vehicle developing the condition satisfies a first threshold;

perform preliminary aspects of selecting a replacement Unmanned Aerial Vehicle in response to the determination; and store results of performing preliminary aspects of selecting a replacement Unmanned Aerial Vehicle in system memory.

12. A system, the system comprising:

one or more processors;

system memory coupled to the one or more processors, the system memory storing instructions that are executable by the one or more processor;

a plurality of Unmanned Aerial Vehicles; and the one or more processors executing the instructions stored in the system memory to optimize deployment of Unmanned Aerial Vehicle resources to satisfy requests for Unmanned Aerial Vehicles resources, including the following:

receive Unmanned Aerial Vehicle resource requirements from a client;

convert the Unmanned Aerial Vehicle resource requirements to a mission having a plurality of mission requirements;

select a first Unmanned Aerial Vehicle and a second Unmanned Aerial Vehicle, from the plurality of Unmanned Aerial Vehicles to perform the mission by considering the capabilities of each available Unmanned Aerial Vehicle in the plurality of Unmanned Aerial Vehicles relative to the plurality of mission requirements to select the first Unmanned Aerial Vehicle having minimal acceptable resources for performing a first subset of the plurality of mission requirements and to select the second Unmanned Aerial Vehicle having minimal acceptable resources for performing a second subset of the plurality of mission requirements;

instruct a flight plan calculator to calculate a first flight plan for the first Unmanned Aerial Vehicle and submit the first flight plan to a civilian aviation authority;

instruct the flight plan calculator to calculate a second flight plan for the second Unmanned Aerial Vehicle and submit the second flight plan to the civilian aviation authority;

send a deploy order to deploy the first Unmanned Aerial Vehicle into flight to perform the first subset of the plurality of mission requirements in accordance with the flight plan and to deploy the second Unmanned Aerial Vehicle into flight to perform the second subset of the plurality of mission requirements in accordance with the second flight plan, in order to satisfy the plurality of mission requirements;

after the deployment of the first Unmanned Aerial Vehicle and the second Unmanned Aerial Vehicle and while the performance of the first subset of the plurality of mission requirements by the first Unmanned Aerial Vehicle and the performance of the second subset of the plurality of mission requirements by the second Unmanned Aerial Vehicle is in progress, receive a status of at least one of the first Unmanned Aerial Vehicle and the second Unmanned Aerial vehicle;

in response to receiving the status, refer to a failure condition database to calculate a possibility of the at least one Unmanned Aerial Vehicle developing a condition inhibiting the ability of the at least one Unmanned Aerial Vehicle to complete the mission based on the received status;

determine that the possibility of the at least one Unmanned Aerial Vehicle developing the condition satisfies a first threshold;

perform preliminary aspects of selecting at least one replacement Unmanned Aerial Vehicle in response to the determination; and store results of performing preliminary aspects of selecting at least one replacement Unmanned Aerial Vehicle in system memory.

13. The system of claim 12, wherein the one or more processors executing the instructions stored in the system memory to select a first Unmanned Aerial Vehicle and a second Unmanned Aerial Vehicle the one or more processors executing the instructions stored in the system memory to select the first Unmanned Aerial Vehicle from a first fleet owned by a first owner and to select the second Unmanned Aerial Vehicle from a second fleet owned by a second owner.

* * * * *